US012077887B2

(12) United States Patent
Lonati et al.

(10) Patent No.: US 12,077,887 B2
(45) Date of Patent: Sep. 3, 2024

(54) PROCESS FOR MAKING A TUBULAR TEXTILE ARTICLE, IN PARTICULAR AN UPPER FOR FOOTWEAR, WITH A CIRCULAR KNITTING MACHINE

(71) Applicant: SANTONI S.P.A., Brescia (IT)

(72) Inventors: Andrea Lonati, Brescia (IT); Silvio Cotali, Rezzato (IT); Paolo Cristini, Brescia (IT)

(73) Assignee: SANTONI S.P.A., Brescia (IT)

( * ) Notice: Subject to any disclaimer, the term of this patent is extended or adjusted under 35 U.S.C. 154(b) by 112 days.

(21) Appl. No.: 17/793,246

(22) PCT Filed: Dec. 23, 2020

(86) PCT No.: PCT/IB2020/062398
§ 371 (c)(1),
(2) Date: Jul. 15, 2022

(87) PCT Pub. No.: WO2021/144645
PCT Pub. Date: Jul. 22, 2021

(65) Prior Publication Data

US 2023/0056687 A1 Feb. 23, 2023

(30) Foreign Application Priority Data

Jan. 16, 2020 (IT) ..... 102020000000766

(51) Int. Cl.
*D04B 1/10* (2006.01)

(52) U.S. Cl.
CPC ..... *D04B 1/108* (2013.01); *D10B 2403/023* (2013.01); *D10B 2403/0331* (2013.01); *D10B 2501/043* (2013.01)

(58) Field of Classification Search
CPC . D04B 1/108; D04B 9/20; D04B 9/42; D04B 9/46; D04B 9/56; A43B 1/04;
(Continued)

(56) References Cited

U.S. PATENT DOCUMENTS 3,601,818 A * 8/1971 Chesebro ..... A41B 11/00 66/171
10,077,512 B2 * 9/2018 Kuo ..... D04B 1/00
(Continued)

FOREIGN PATENT DOCUMENTS

EP 2875745 A1 5/2015
IT UB20153915 A1 3/2017
(Continued)

OTHER PUBLICATIONS

Search Report dated Mar. 29, 2021 in corresponding International Application No. PCT/IB2020/062398, 4 pages.
Written Opinion dated Mar. 29, 2021 in corresponding International Application No. PCT/IB2020/062398, 9 pages.

*Primary Examiner* — Danny Worrell
(74) *Attorney, Agent, or Firm* — MH2 TECHNOLOGY LAW GROUP LLP

(57) ABSTRACT

A process for making a tubular textile article destined to represent an upper for footwear comprising programming a textile machine defining a tubular textile article to be made, extending longitudinally in a seamless way starting from a first open end and consisting of a plurality of stitch rows in succession. The process further includes knitting, in accordance with the programming step, by making the first end, belonging to a first fabric of the textile article, destined to represent a tip end of an upper; making a tip portion of the first fabric, destined to represent a portion of the upper enclosing the toe; making a tab, belonging to the first fabric and destined to represent a portion of the upper enclosing or covering at least one portion of instep; making a middle portion of the first fabric, destined to represent a portion of the upper enclosing at least part of the sole and sides of the foot, wherein the middle portion has a longitudinal opening which is located on at least one portion of the instep, and two lateral margins on the sides of the longitudinal opening; and making an end portion of the first fabric destined to represent
(Continued)

a portion of the upper enclosing the foot heel. The tab and the longitudinal opening of the middle portion both have a simultaneous longitudinal development, in a direction corresponding to the longitudinal development of the upper; the knitting step entirely produces the unitary, single-piece tubular textile article; the steps are performed in succession such that processing is never interrupted between each step and the following one.

19 Claims, 13 Drawing Sheets

(58) Field of Classification Search
CPC ..... A43B 23/0245; A43B 23/042; D10B 2403/023; D10B 2403/0331; D10B 2501/043
See application file for complete search history.

(56) References Cited

U.S. PATENT DOCUMENTS

| | | | | |
|---|---|---|---|---|
| 2016/0143394 | A1* | 5/2016 | Ikenaka | D04B 1/106 66/170 |
| 2016/0198797 | A1* | 7/2016 | Ikenaka | A43B 23/0245 12/142 G |
| 2016/0213097 | A1* | 7/2016 | Uchikawa | D04B 1/22 |
| 2017/0135435 | A1* | 5/2017 | Ikenaka | A43B 1/04 |
| 2018/0132558 | A1* | 5/2018 | Berrian | D04B 1/24 |
| 2018/0235318 | A1* | 8/2018 | Terai | A43B 23/0235 |
| 2020/0205481 | A1* | 7/2020 | Amis | A41B 11/004 |

FOREIGN PATENT DOCUMENTS

| | | | |
|---|---|---|---|
| WO | 2014131762 | A2 | 9/2014 |
| WO | 2018162494 | A2 | 9/2018 |

* cited by examiner

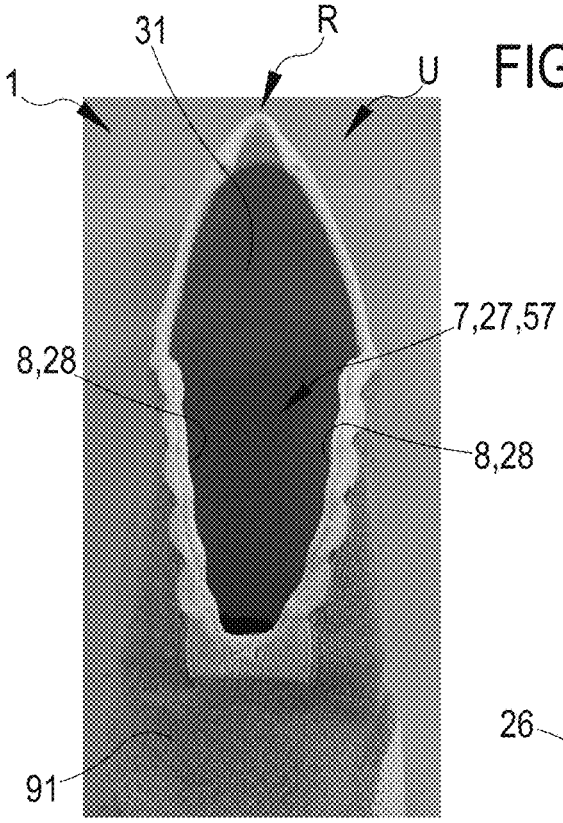
FIG.16
FIG.17
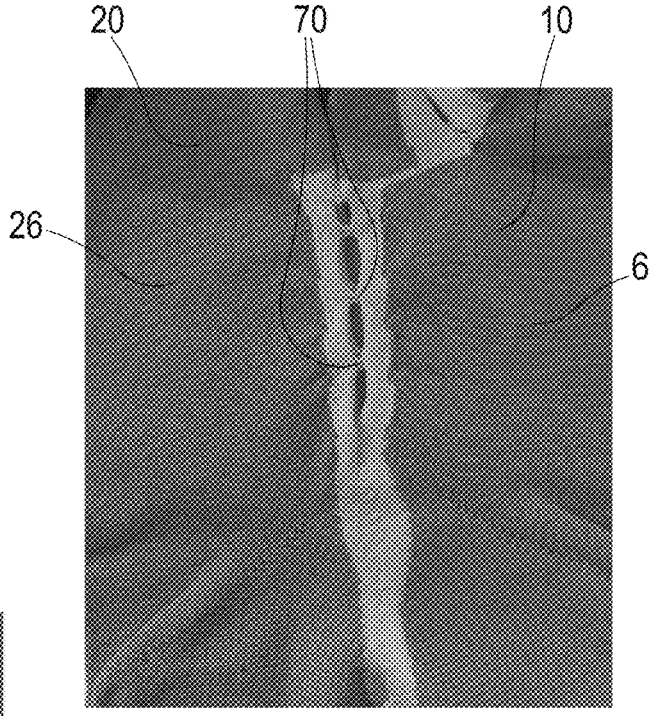
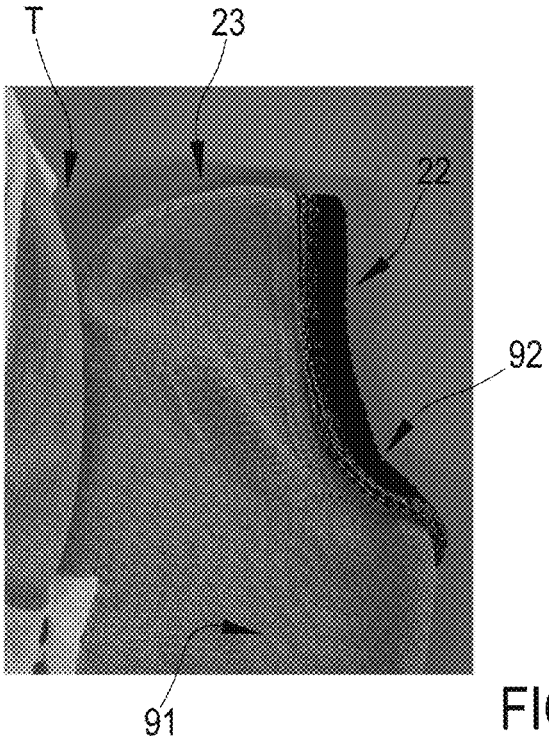
FIG.18

PROCESS FOR MAKING A TUBULAR TEXTILE ARTICLE, IN PARTICULAR AN UPPER FOR FOOTWEAR, WITH A CIRCULAR KNITTING MACHINE

CROSS-REFERENCE TO RELATED APPLICATIONS

This application is a U.S. National Stage application of PCT/IB2020/062398 filed Dec. 23, 2020, pending, which claims priority to Italian Application No. 102020000000766 filed Jan. 16, 2020, the entire disclosures of which are hereby incorporated by reference.

FIELD OF THE INVENTION

The present invention relates to a process for making a tubular textile item by means of a circular knitting machine for knitted or hosiery items. The present invention further relates to a shoe upper made with a tubular knitted item obtained by means of said process.

In particular, the present invention concerns a knitting design, preferably an "intarsia" design made on a circular weft knitting machine so as to obtain a single or double fabric tubular knitted item destined to be a shoe upper.

BACKGROUND OF THE INVENTION

It is known about the use of circular knitting machines for manufacturing tubular items designed for a shoe upper. Such tubular items, once manufactured by the knitting machine, typically undergo a series of operations, such as cutting, sewing, application of additional portions, etc., in order to obtain an upper apt to be suitably associated with a sole for making a shoe.

It is also known, when manufacturing an upper obtained by means of a circular knitting machine, about manufacturing a tubular knitted item which, at the end of the process, has a "double fabric", i.e. consists of two different overlapping layers or cloths of fabric, where a cloth represents an inner fabric while the other cloth represents an outer fabric of the upper. To this purpose the tubular knitted item is produced starting from a first end, which will then represent the toe of the inner fabric (or of the outer fabric), and is manufactured on its whole length as far a second end, which will then represent the toe of the outer fabric (or of the inner fabric). The tubular knitted item thus manufactured therefore has on its whole length development the inner fabric followed, in a continuous manner, by the outer fabric (or vice versa, the outer fabric followed by the outer fabric). After being manufactured on the machine, the tubular knitted item is suitably manipulated so as to partially turn it on itself, folding the inner fabric (starting e.g. from the second end) over the outer fabric (towards the first end), until two overlapping fabrics (an inner fabric and an outer fabric) and thus a double fabric upper are obtained. It is evident that, in the middle or in another intermediate area of the tubular knitted item (placed between the first and second end), the outer fabric is turned over the inner fabric, and the resulting, double fabric upper thus develops between a front edge or border, in which the first and second end overlap, of the original tubular knitted item, and a rear edge or border, corresponding to the fold line of the outer fabric over the inner fabric.

SUMMARY

In the framework of the production of uppers by means of circular knitting machines as the ones disclosed above, the Applicant has identified the presence of some drawbacks.

First of all, the Applicant has observed that known, uppers exhibit a structure that is not able to impart specific technical and functional characteristics to the upper itself.

The Applicant has further observed that known processes for manufacturing uppers, in particular double fabric uppers by means of circular knitting machine enable only a limited number of possible structures for the tubular knitted item making the upper, which limits the results that can be obtained.

Moreover, in particular in the framework of uppers for footwear, known processes make tubular items that may then require the addition of further knitted portions for completing the upper, or require further processing for manufacturing the upper. This may make upper manufacturing complex and/or expensive, or further require a long time to be completed.

Under these circumstances, an aim underlying the present invention, in its various aspects and/or embodiments, is to propose a process for manufacturing a tubular knitted item, with a circular knitting machine, that is able to solve the problems disclosed above and to overcome the limitations of known techniques.

In particular, an aim of the present invention is to propose a process for manufacturing a tubular knitted item that is able to provide a tubular textile item from which a single or double fabric upper can be obtained, with specific structural characteristics that can impart given technical properties to the upper itself. In further detail, an aim of the present invention is to propose a process that allows to manufacture a tubular knitted item from which an upper with specific characteristics of appearance and/or of comfort and wearability can be obtained.

A further aim of the present invention is to propose a process for manufacturing a tubular knitted item that enables to create a large number of differentiated structures, in particular so as to obtain a wide variety of possible single or double layer uppers.

A further aim of the present invention is to propose a process that enables to manufacture shoe uppers in an economically competitive manner.

A further aim of the present invention is to create alternative solutions to the prior art for manufacturing tubular knitted items and single or double layer uppers, and/or to open new design possibilities.

These and other possible aims, which shall appear better from the following description, are basically achieved by a process for manufacturing a tubular knitted item and by a shoe upper manufactured with a tubular knitted item obtained by means of this process, according to one or more of the appended claims and according to the following aspects and/or embodiments, variously combined, possibly also with the aforesaid claims.

In a first aspect, the invention relates to a process for manufacturing a tubular knitted item by means of a circular knitting machine.

In one aspect, the process manufactures a tubular textile item with an intarsia design.

In the present description and in the claims attached thereto, the wording "intarsia design", as known in the field of knitwear, relates to a design made up of alternating knitted areas obtained with yarns supplied by one or more feeds of the machine, which does not have floating yarns on the reverse side, i.e. yarns connecting portions of the same knitted course that are at a distance from one another and obtained with their own yarn, and which does not have yarn cutting or trimming at the ends of each course portion making up a design area.

By way of summary, "intarsia" designs are textile designs with motives, colors and knitted patterns differentiated in the various areas of the item, which do not exhibit trimmed yarns and/or can avoid the presence of floating yarns.

In the present invention and in the claims attached thereto, each a fabric portion made in the steps A, B, C, D, E or F is to be understood as any portion or area of the item included in a given group or section of adjacent needles for a given number of knitted courses. In other words, each portion has a longitudinal development, i.e. along a direction of development corresponding to the forward movement of the fabric being formed, for a given number of courses, and a lateral development, i.e. in a direction orthogonal to the longitudinal development (and corresponding to the development of the needle bed), for a given number of needles, which may also vary for each course involved in the area and may also coincide with the whole number of needles of the needle bed. Each portion can have any shape, with given profiles and size along a direction of development of the fabric (longitudinally) and along the direction of the knitted course (laterally); each portion is therefore characterized by a given knitted pattern and by special yarns being used.

Intarsia designs can be made with rectilinear or circular knitting machines for knitwear or hosiery items enabling to move the feeds on which the yarns are supplied with respect to the needle holder, the latter consisting either of a rectilinear needle bed or of a cylinder, or vice versa, i.e. enabling to move the needle holder with respect to the feeds, according to two directions of motion opposed to one another, i.e. with a forward motion and with a backward motion (processing with alternating motion).

Generally, intarsia designs are made, when manufacturing each knitted course making up the intarsia design, by correlating and actuating the needles arranged in a section of the needle holder to a feed and correlating and actuating the needles arranged in another, adjacent or neighboring, section of the needle holder to another feed. The number of feeds and sections of the needle holder correlated thereto varies according to the number of different areas of the design to be obtained and, as disclosed above, the number of needles of each section of the needle-holding section can be varied for each course so as to vary the shape of the different areas of the intarsia design to be obtained.

The alternating motion of the needle holder with respect to the feeds of the machine enables to process portions of knitted courses with yarns supplied by different feeds without cutting the yarns at the end of the corresponding portion of knitted course or without letting floating on the reverse the yarns that are not used for processing a successive portion of knitted course and waiting to be used again for forming a further portion of knitted course.

The connection of two adjacent areas of the design, processed with yarns supplied on two different feeds, is preferably obtained by actuating at least one needle, located on the boundary between the sections and belonging to either of these sections, both on the feed correlated to its groups of needles and on the feed correlated to the adjacent or neighboring group of needles.

Generally, intarsia designs are used for obtaining knitted patterns and motives consisting of areas of knitted fabric manufactured with yarns of different color or type, which are supplied to different feeds.

Some aspects of the invention are listed below.

In one aspect, the process for making a tubular textile item, by means of a circular knitting machine, destined to represent an upper for footwear, comprises a step of—arranging a circular textile machine having at least one feed and a needle holder supporting a plurality of needles, defining a circular needle bed, which can be operated to pick up the threads dispensed by said at least one feed and to form knitted fabric; said needle holder is rotatable relative to said feed and said feed is arranged in proximity to said needle holder.

In one aspect, the process comprises a step of programming said textile machine so as to define a tubular textile article to be made, extending longitudinally in a seamless way starting from a first open end and consisting of a plurality of stitch rows in succession.

In one aspect, the process comprises a step of producing knitted fabric with said circular textile machine so as to manufacture said tubular knitted item, destined to represent an upper for footwear, according with the aforesaid programming step.

In one aspect, the knitting step comprises a step A) of making the first open end, belonging to a first fabric of the textile article, using a needle sector, or all the needles, of said needle bed, said first open end being destined to represent a tip end of an upper.

In one aspect, the knitting step comprises a step B) of making a tip portion of the first fabric, comprising a certain number of stitch rows and consisting of a stitch bulge obtained using, in successive rows, first an increasing or decreasing number of needles per row and then (similarly) a decreasing or increasing number of needles per row, said tip portion of the first fabric being destined to represent a portion of the upper suitable for accommodating or enclosing the toe or part thereof.

In one aspect, the knitting step comprises an optional step C) of making a bulge-free portion of complete tubular knitted fabric, along the longitudinal development of said first fabric, comprising a respective number of stitch rows and wherein for each row the knitted fabric produced has a closed circular profile.

In one aspect, the knitting step comprises a step D) of making a tab, belonging to said first fabric and destined to represent a portion of the upper suitable for enclosing or covering at least one portion of the neck of the foot/instep, wherein said step of making a tab involves interrupting the processing of the preceding rows, and continuing knitting using a needle sector or all the needles of said needle bed for a certain number of stitch rows, thus producing a knitted insert representing the tab.

In one aspect, the knitting step comprises a step E) of making a middle portion of the first fabric, comprising a respective number of stitch rows and destined to represent a portion of the upper suitable for enclosing at least part of the sole and sides of the foot, said middle portion of the first fabric having a longitudinal opening (without stitches), destined to be located on at least one portion of the instep, and two lateral margins on the sides of said longitudinal opening. In one aspect, said middle portion of the first fabric is made by using, in operation, a respective needle sector of said needle bed, comprising any number of needles up to a number including all the needles of the needle bed, for a certain number of stitch rows, it being possible to change said respective needle sector for each row comprised in the middle portion.

In one aspect, the knitting step comprises a step F) of making a tip portion of the first fabric, comprising a certain number of stitch rows and consisting of one or more stitch bulges each obtained using, in respective successive rows, first an increasing or decreasing number of needles per row and then (similarly) a decreasing or increasing number of needles per row, said tip portion of the first fabric being destined to represent a portion of the upper suitable for accommodating or enclosing the foot heel or part thereof.

In one aspect, in steps D and E the tab and the longitudinal opening of the middle portion are made such that they both have a substantially simultaneous longitudinal development, in a direction corresponding to a longitudinal development of the upper.

In one aspect, steps D and E make the tab and the middle portion, seamlessly with respect to each other, so that in the upper resulting from the tubular knitted item the tab is below the longitudinal opening.

In one aspect, the knitting step entirely produces the unitary, single-piece tubular textile article, i.e. without separate parts.

In one aspects, the steps are performed in succession such that processing is never interrupted between each step and the following one.

In one aspect, steps D and E make the tab and the middle portion, seamlessly with respect to each other, so that—in the upper resulting from the tubular knitted item—the tab is at least partially covered or overhung by said lateral margins of the middle portion.

In one aspect, step A is the first step performed in said knitting step with said circular textile machine, the knitting of said textile article starting from said first open end.

In one aspect, step A is the last step performed in said knitting step with said circular textile machine, the knitting of said textile article ending with said first open end.

In one aspect, said knitting step involves performing the steps in sequence in an order A-B-C (optional step)-D-E-F, seamlessly between each step and the following one.

In one aspect, said knitting step involves performing the steps in sequence in an order F-E-D-C (optional step)-B-A, seamlessly between each step and the following one.

In general, in the aforesaid sequences steps C are optional.

In one aspect, step A is performed with the textile machine operating in a continuous motion, i.e. producing rows of complete tubular knitted fabric through a continuous revolution of the needle holder in a given direction.

In one aspect, step A can be performed with the textile machine operating in an alternating motion, through an alternation of revolutions of the needle holder in one direction and in the opposite direction, producing rows of complete tubular knitted fabric.

In one aspect, step A comprises a step of making an elastic edge of said first open end.

In one aspect, step B is performed with the textile machine operating in an alternating motion, so as to make the tip portion of the first fabric, through an alternation of revolutions of the needle holder in one direction and in the opposite direction, using in each revolution a certain needle sector with a respective number of needles of the circular needle bed.

In one aspect, step C is performed with the textile machine operating in a continuous motion, i.e. producing rows of complete tubular knitted fabric through a continuous revolution of the needle holder in a given direction.

In one aspect, step D is performed with the textile machine operating in an alternating motion, so as to make the tab, through an alternation of revolutions of the needle holder in one direction and in the opposite direction, using in each revolution a certain group of number of needles, selected within needle sector of the circular needle bed chosen for making the tab.

In one aspect, in step D the number of needles used in each revolution with an alternating motion of the textile machine can be varied so as to shape the tab along its longitudinal development, one row after another.

In one aspect, in step D the needle sector used in each revolution with an alternating motion of the textile machine can comprise any number of needles up to a maximum of all the needles of the needle bed.

In one aspect, in step D only one needle sector of the needle bed is used, and within such sector all the needles or only some of them may work, depending on the textile features desired for the tab.

In one aspect, step D ends when the desired length of the tab is achieved, with the unloading of the needles used for making the tab itself, which ends with a free edge, i.e. not connected to other parts of the textile article, and the insert representing the tab consists of a single layer of fabric connected to the textile article (only) on the stitch made at the beginning of step D.

In one aspect, step D:

starts by selecting, with an alternating motion, a sector of needles used for making the tab, and within such sector a certain number of needles is kept in the idle position for the entire processing of the tab, which is made with the remaining needles of said sector;

continues by longitudinally developing the tab in a continuous way, for an extension which is twice its final extension;

ends by resuming the processing by the above-mentioned needles previously kept in the idle position, so that the last stitch made in step D is located at the first stitch made in step D;

in this way, the tab consists of a double fabric, that is, two layers of fabric folded onto each other along a fold line, the latter substantially corresponding to the stitch made halfway through step D.

Basically, step D produces a tab starting and ending in the same place as the textile item, and once the tab is flattened, it thus has a double fabric structure, whose length corresponds to half of the longitudinal extension of the stitch made in step D.

In one aspect, making the double fabric tab provides for the textile processing in step D to end with the same number of needles with which step D itself started.

In one aspect, step D involves textile processing known in the art with the term "button", which allows to start and end the tab in the same position, seamlessly with the rest of the textile article, i.e. with the fabric made in steps C, or B, and E.

In one aspect, in step D the step of interrupting the processing involves stopping a certain number of needles which are contiguous in operation in the preceding rows.

In one aspect, in step D the step of continuing knitting involves continuing only with one needle sector of said needle bed.

In one aspect, if step D makes a tab consisting of a double fabric, the tab has two free lateral edges, each extending along the entire longitudinal development of the double fabric tab, said two lateral edges being linear or shaped, the double fabric tab having two lateral openings on the two lateral edges.

In one alternative aspect, if step D makes a tab consisting of a double fabric, the tab has two lateral edges, each extending along the entire longitudinal development of the double fabric tab, wherein:

the two lateral edges are made for a first half of the longitudinal extension of the tab, i.e. up to said fold line, by inserting one or more scales, preferably a plurality of scales, i.e. reducing the number of needles in operation and leaving the excluded needles, in the idle position, with the knitted fabric retained in the needle head;

the two lateral edges are made for a second half of the longitudinal extension of the tab, i.e. beyond said fold line, gradually resuming the above-mentioned scales, i.e. increasing the number of needles in operation and reconnecting the knitted stitches of the needles previously excluded to the knitted fabric made in the second half of the lateral edges;

thus obtaining a double fabric tab wherein each of the two lateral edges has ties between its first half and its second half, along the longitudinal development, so that on the lateral edges of the double fabric tab there are one or more closing stitches, each corresponding to a respective knitted fabric scale.

In one aspect, step D is performed seamlessly with respect to step B, i.e. the tab is made from the tip portion of the first fabric without variations in the knitted structure.

In one aspect, step E is performed with the textile machine operating in an alternating motion, so as to make the middle portion of the first fabric, through an alternation of revolutions of the needle holder in one direction and in the opposite direction, using in each revolution a certain needle sector with a respective number of needles of the circular needle bed.

In one aspect, in step E the number of needles used in each revolution with an alternating motion of the textile machine can be varied so as to shape the middle portion of the first fabric and the longitudinal opening, one row after another.

In one aspect, in step E the number of needles used in each revolution with an alternating motion of the textile machine can be any number of needles up to a maximum of all the needles of the needle bed.

In one aspect, in step E only one needle sector of the needle bed is used, and within such section all the needles or only some of them may work, depending on the textile featured desired for the middle portion of the first fabric.

In one aspect, step E provides for a progressive variation in the number of needles used in making the knitted fabric, in order to give the above-mentioned longitudinal opening of the middle portion of the first fabric a "V" shape.

In one aspect, said progressive variation in the number of needles in step E can be:

a progressive decrease in the number of needles if the median portion of the first fabric is made following step D and before step F, i.e. by first making a final vertex of the longitudinal opening;

a progressive increase in the number of needles if the median portion of the first fabric is made following step F and before step D, i.e. by lastly making a final vertex of the longitudinal opening.

In one aspect, step F is performed with the textile machine operating in an alternating motion, so as to make the end portion of the first fabric, through an alternation of revolutions of the needle holder in one direction and in the opposite direction, using in each revolution a certain needle sector with a respective number of needles of the circular needle bed.

In one aspect, the end portion of the first fabric ends, at the end of step F, with an open stitch, i.e. with a stitch without a closed circular profile.

In one aspect, step F comprises a step of making an edge of said end portion of the first fabric.

In one aspect, in the transition from step D to step E a replacement of the needles being used takes place, i.e. in step D, needles belonging to a needle sector are used to make the tab close to the longitudinal opening made in step E (or longitudinally thereon) and/or belonging to a needle sector not used in step E during the definition of the longitudinal opening of the middle portion of the first fabric, thus causing the tab to be at least partially overlapped by the lateral margins of the middle portion, and vice versa the longitudinal opening of the middle portion shows at least partially, underneath the same, the tab.

In one aspect, if making the middle portion of the first fabric in step E does not affect all the needles in the needle bed, one or more of the needles not used, in the definition of the longitudinal opening, correspond to needles that contribute in step D to making the tab, or that belong to the needle sector selected for making the tab T.

In one aspect, if making the tab in step D has not affected all the needles in the needle bed, in step E, for making the middle portion of the first fabric, at least some needles belonging to the sector of needles not selected in step D for making the tab are used.

In one aspect, in the upper resulting from the tubular item, the tab is not completely covered and accessible from outside (in particular from above) on the longitudinal opening of the middle portion, in the area between the two margins of the longitudinal opening.

In one aspect, the longitudinal development of the upper coincides with the length development of the user's foot.

In one aspect, the knitting step comprises a step F') of making, seamlessly with the end portion of the first fabric, made in step F, an initial portion of a second fabric of the textile article, extending longitudinally in a seamless way with respect to the first fabric, the initial portion of the second fabric comprising a certain number of stitch rows and consisting of one or more stitch bulges, each obtained using, in respective successive rows, first an increasing or decreasing number of needles per row and then (similarly) a decreasing or increasing number of needles per row, said initial portion of the second fabric being destined to represent a portion of the upper suitable for accommodating or enclosing the foot heel or part thereof.

In one aspect, the knitting step comprises a step E') of making a middle portion of the second fabric, comprising a respective number of stitch rows and destined to represent a portion of the upper suitable for enclosing at least part of the sole and sides of the foot, said middle portion of the second fabric having a respective longitudinal opening, destined to be located on at least one portion of the neck of the foot, and two respective lateral margins on the sides of said longitudinal opening, wherein said middle portion of the second fabric is made by using, in operation, a respective needle sector of said needle bed, comprising a preferred number of needles up to a number including all the needles of the needle bed, for a certain number of stitch rows, it being possible to change said respective needle sector for each row comprised in the middle portion.

In one aspect, the knitting step comprises a step C') of making a bulge-free portion of complete tubular knitted fabric, along the longitudinal development of said second fabric, comprising a respective number of stitch rows and wherein for each row the knitted fabric produced has a closed circular profile.

In one aspect, the knitting step comprises a step B') of making a tip portion of the second fabric, comprising a certain number of stitch rows and consisting of a stitch bulge obtained using, in successive rows, first an increasing or decreasing number of needles per row and then (similarly) a decreasing or increasing number of needles per row, said tip portion of the second fabric being destined to represent a portion of the upper suitable for accommodating or enclosing the toe or part thereof.

In one aspect, the knitting step comprises a step A') of making a second open end of the textile item, corresponding to an end of the second fabric, using a needle sector, or all the needles, of said needle bed, said second open end being destined to represent a tip end of an upper.

In one aspect, longitudinal development of the textile article means the development thereof along the knitting direction of the textile machine; in this sense the longitudinal development has a curvilinear progress depending on the type of knitted fabric made and on the needles used for each row.

In one aspect, the second open end of the textile item is longitudinally opposed to said first open end.

In one aspect, the tubular textile article develops seamlessly between the first and the second end.

In one aspect, the first and second open ends of the textile item represent a beginning and an end, or vice versa an end and a beginning, of said step of knitting with said circular textile machine and in accordance with said programming step.

In one aspect, the second fabric does not include knitted portions or steps configured for defining a tab as the one made, in the first fabric, in step D; in other words, the second fabric does not include a tab overhung by the lateral margins of the middle portion (partially covering the foot neck). The second fabric may however be provided with other knitted inserts rising in certain positions.

In one aspect, the second fabric is symmetrical and structurally specular, with the exception of the tab, with respect to the first fabric, i.e. the second fabric comprises the same portions as the first fabric made with the same step, with the exception of the tab, and wherein:

- the first open end made in step A and the second open end made in step A' are corresponding to one another, both open ends being destined to represent, or to be located at, one tip end of an upper; and/or
- the tip portion of the first fabric made in step B and the tip portion of the second fabric made in step B' are corresponding to one another, both tip portions being destined to represent, or be located at, one portion of the upper suitable for accommodating or enclosing the toe or part thereof; and/or
- the portion of complete tubular knitted fabric of the first fabric made in step C and the portion of complete tubular knitted fabric of the second fabric made in step C' are corresponding to one another; and/or
- the middle portion of the first fabric made in step E and the middle portion of the second fabric made in step E' are corresponding to one another, and in particular have corresponding longitudinal openings (without knitted fabric), destined to be located at a same portion of the neck of the foot, and corresponding lateral margins on the sides of the respective longitudinal opening, both middle portions being destined to represent, or to be located at, one portion of the upper suitable for enclosing at least part of the sole and the sides of the foot; and/or
- the end portion of the first fabric made in step F and the initial portion of the second fabric made in step F' are corresponding to one another, both tip portions being destined to represent, or be located at, one portion of the upper suitable for accommodating or enclosing the heel of the foot or part thereof.

In one aspect, the second fabric is made in the opposite direction with respect to the first fabric, i.e. the second fabric develops from the end of the end portion of the first fabric in a specular and seamless manner, starting from its initial portion.

In one aspect, the second fabric is made with the same steps in reversed order with respect to the first fabric, except for step D which is not included for the second fabric.

In one aspect, the second fabric is made seamlessly with the first fabric, the tubular textile item being unitary and single-piece, i.e. without separate parts.

In one aspect, step A' is the last step performed in said knitting step with said circular textile machine, the knitting of said textile article ending with said second open end of the textile article, belonging to the second fabric.

In one aspect, step A' is the first step performed in said knitting step with said circular textile machine, the knitting of said textile article starting from said second open end of the textile article, belonging to the second fabric.

In one aspect, said knitting step involves performing the steps in sequence in an order A-B-C-D-E-F-F'-E'-C'-B'-A', seamlessly between each step and the following one.

In one aspect, said knitting step involves performing the steps in sequence in an order A'-B'-C'-E'-F'-F-E-D-C-B-A, seamlessly between each step and the following one.

In the above-mentioned sequences steps C and C' are optional.

The operation of the textile machine, either with a continuous or alternating motion, in steps A', B', C', E', F' preferably corresponds to the description of steps A, B, C, E, F.

In one aspect, the first fabric of the textile article is the one comprising the tab, the second fabric is the one without the tab.

Basically, it does not matter which of the two fabrics is produced first: the first fabric is always the one comprising the tab made in step D.

In one aspect, the method may comprise, when making said second fabric, even only one or some of said steps F', E', C', B', A'.

In one aspect, the first fabric comprises an external surface and an internal surface, and the second fabric comprises a respective external surface and a respective internal surface, wherein the external surface of the first fabric is connected to, and continues seamlessly in, the external surface of the second fabric, and the internal surface of the first fabric is connected to, and continues seamlessly in, the internal surface of the second fabric.

In one aspect, the method comprises, following the knitting step with the circular textile machine to make the tubular textile article, a step of manipulating and folding the textile article to make an upper, and in such a way that:

- the first fabric, that is the fabric comprising the tab, is folded inside the second fabric, along a folding profile;
- the inside of the first fabric contacts the inside of the second fabric, both—with the upper in use—without contacting the user's foot or the outside of the upper;
- the outside of the first fabric is folded inside the second fabric, so that the outside of the first fabric is, with the upper in use, facing or directed to the user's foot;
- the outside of the second fabric represents—with the upper in use—an external surface of the upper.

In one aspect, the first fabric is the one destined to be folded inside the second fabric.

In one aspect, following said step of manipulating and folding the textile article, the portions representing the second fabric match and contact the corresponding portions representing the first fabric, and in particular:

- the first open end made in step A matches the second open end made in step A', obtaining a double-layer open end;
- the tip portion of the first fabric made in step B matches the tip portion of the second fabric made in step B', obtaining a double-layer tip portion;
- the portion of complete tubular knitted fabric of the first fabric made in step C matches the portion of complete tubular knitted fabric of the second fabric made in step C', obtaining a double-layer complete tubular knitted fabric;
- the middle portion of the first fabric made in step E matches the middle portion of the second fabric made in step E', obtaining a double-layer middle portion;
- the longitudinal opening of the first fabric matches the longitudinal opening of the second fabric, obtaining a double-layer longitudinal opening;
- the lateral margins of the middle portion of the first fabric match the lateral margins of the middle portion of the second fabric, obtaining double-layer lateral margins;
- the end portion of the first fabric made in step F matches the initial portion of the second fabric made in step F', obtaining a double-layer end portion.

In one aspect, step F involves making, at the end of the end portion of the first fabric, an end zone of the first fabric, destined to represent a portion of the upper apt to enclose the user's ankle or part thereof, and step F' involves making, at the beginning of the initial portion of the second fabric, a respective end zone of the second fabric, destined to represent a portion of the upper apt to enclose the user's ankle or part of it.

In one aspect, the end zone the first fabric made in step F and the end zone of the second fabric made in step F' are corresponding to one another.

In one aspect, the end zone of the second fabric, made in step F', develops seamlessly with respect to the end zone of the first fabric, made in step F.

In one aspect, the end zone of the first fabric made in step F and the end zone of the second fabric made in step F' are in contact with each other on, i.e. they have in common, a folding curve belonging to said folding profile, on which the first fabric is folded inside the second fabric.

In one aspect, folding the first fabric inside the second fabric, in correspondence of the folding curve, generates a rear insert of the double fabric upper, apt to enclose from behind the user's ankle or part thereof.

In one aspect, the rear insert of the upper is configured for being grasped when introducing the foot into the upper so as to simplify such operation.

In one aspect, the rear insert of the upper is configured for enclosing or protecting the user's ankle, or for increasing the comfort of such portion of the upper.

In one aspect, the folding curve separates the first fabric from the second fabric, which is considered as a global longitudinal development of the tubular item corresponding to the manufacturing direction of the item itself.

In one aspect, the end zone of the first fabric made in step F and the end zone of the second fabric made in step F' represent together an intermediate portion of the tubular textile item, along a manufacturing direction of the item itself.

In one aspect, the method comprises, after the step of manipulating and folding the textile article, a step of applying a sole below a portion of the textile article.

In one aspect, following said step of manipulating and folding the textile article so as to make an upper, the tab reaches below both longitudinal openings of the first and second fabric and is at least partially covered or overhung by both pairs of lateral margins of the middle portions of the first and second fabric.

In one aspect, the upper comprises the first fabric only, thus being a single layer upper.

In one alternative aspect, the upper comprises the first and the second fabric, thus being a double layer upper.

Manipulating the textile article so as to complete the assembly of the double fabric (or double layer) upper involves that the first fabric, comprising the tab, is inserted into the second fabric, without the tab, so that the tab belonging to the first fabric is at least partially below the double layer longitudinal opening.

In one aspect, the tab protrudes (i.e. develops) from the outside of the first fabric, which then becomes the inside of the upper (facing the user's foot).

In one aspect, in case of a single fabric (or single layer) upper the tab is covered by the lateral margins of the middle portion of the first fabric (in particular contacting the inside of the first fabric).

In one aspect, in case of a double fabric (or double layer) upper the tab is covered by the lateral margins of the middle portions both of the first and of the second fabric (in particular contacting the outside of the first fabric).

In one possible aspect, in case of a textile item comprising the first and the second fabric:

- in step E, the two lateral margins of the longitudinal opening of the first fabric are made by inserting one or more scales, preferably a plurality of scales, i.e. reducing the number of needles in operation and leaving the excluded needles, in the idle position, with the knitted fabric retained in the needle head;
- subsequently, in step E' the two lateral margins of the longitudinal opening of the second fabric are made by progressively resuming the above-mentioned scales introduced in step E, i.e. increasing the number of needles in operation and reconnecting the knitted stitches of the needles previously excluded to the knitted fabric made in step E;

thus obtaining a double fabric middle portion wherein each of the two lateral margins of the first fabric has ties to the corresponding lateral margin of the second fabric, along the longitudinal development of the margins, such that—once the tubular article has been manipulated to make a double fabric upper—the pairs of corresponding lateral margins of the first and second fabrics have one or more closing stitches, each corresponding to a respective knitted fabric scale.

Basically, the ties are between the middle portions of the first and of the second fabric are obtained by stopping some needles during step E and "waiting" for step E' before being resumed to operation.

Ties are made between the first fabric, which becomes the inside of the upper, and the second fabric, which becomes the outside of the upper.

In one aspect, the ties are positioned on the folding profile between the first and second fabric, that is, along the line where the first fabric is folded inside the second fabric.

It should be pointed out that ties make it easier, during manipulation, to guide and fold the first fabric into the second fabric and to match the corresponding lateral margins of the longitudinal opening of the first and second fabric, so as to complete and make the double layer longitudinal opening.

In one aspect, if the knitting step for making the tubular textile article involves making first the second fabric and then the first fabric, the scales, i.e. the reduction of the number of needles in operation and leaving the excluded needles with the knitted fabric retained, takes place in step E', whereas the progressive resumption of the scales, i.e. the increase of the number of needles in operation connecting back to the knitted fabric the stitches of needles previously excluded, takes place in step E.

In one aspect, the process include a step of closing the first open end of the first fabric.

In one aspect, the step of closing the first end can take place directly on the textile machine producing the textile item, before the item is unloaded from the textile machine, or after unloading the textile item.

In one aspect, the process include a step of closing the second open end of the second fabric.

In one aspect, the step of closing the second end can take place directly on the textile machine producing the textile item, before the item is unloaded from the textile machine, or after unloading the textile item.

In one aspect, the closing step can take place for instance by sewing or bonding or gluing.

In one aspect, the step of manipulating and folding the textile item makes a double fabric upper developing between a front edge, in which the first open end and the second open end of the textile item overlap, and a rear edge, corresponding to at least one portion of the folding (or turning) profile, wherein said front edge is configured for being closed so as to represent the toe of the upper and of the shoe thereof, and said rear edge is designed to receive the user's foot inserted into it.

In one aspect, the step of manipulating and folding the textile item causes the insertion of the first fabric into the second fabric, the second fabric overlapping the first fabric, so that as a result the inner surfaces of the first fabric and of the second fabric, as manufactured by the knitting machine in the tubular item, face each other in contact inside the double fabric upper, and the outer surface of the second fabric, as manufactured by the knitting machine, is visible outside the double fabric upper and the outer surface of the first fabric, as manufactured by the knitting machine, represents the inside of the double fabric item; or vice versa.

In one aspect, in said step of arranging a circular textile machine, said textile machine has the following technical features:

- several feeds, preferably 4 feeds;
- selection of sinkers for each feed;
- possibility of manufacturing terrycloth knitted fabric, in each feed and for each needle, in both movements of the needle holder, i.e. both in the forward and in the backward movement, and/or wherein each feed can deliver at least one respective yarn, in a given color and/or material, irrespective of the respective yarns of the remaining feeds, and/or wherein each feed has a plurality of yarn feeders, so that it can deliver a plurality of different yarns.

In one aspect, the tubular textile article is an article with intarsia design.

In one aspect, in said step of arranging a circular textile machine, said circular textile machine is a circular weft knitting machine for intarsia design, i.e. knitted designs with motifs, colors and knitted patterns differentiated in the various knitted areas, though without trimmed and/or floating yarns on the reverse.

In one aspect, said needle holder can be actuated with an alternating rotary motion with respect to said feed, i.e. with two opposite directions of movement, a forward and a backward movement, respectively, so as to make the needles face said feed one after the other and form a knitted fabric both in the forward and in the backward movement of said needle holder with respect to said feed.

In one independent aspect thereof, the present invention relates to an upper for footwear made with a tubular textile article obtained by a process according to any one of the preceding claims.

Further characteristics and advantages will be more evident from the detailed description of a preferred, though not exclusive, embodiment of a process for manufacturing a tubular textile article by means of a circular textile machine, and an upper for footwear according to the present invention.

DESCRIPTION OF THE DRAWINGS

This description shall be made below with reference to the accompanying drawings, provided to a merely indicative and therefore non-limiting purpose, in which:

FIG. 16 shows a further detail of the tubular article of FIG. 10; in particular, it shows an upper portion of the textile article;

FIG. 17 shows a further detail of the tubular article of FIG. 10; in particular, it shows lateral portions of the textile article;

FIG. 18 shows a further detail of the tubular article of FIG. 10; in particular, it shows an end portion of the textile article;

DETAILED DESCRIPTION

Figure 1:
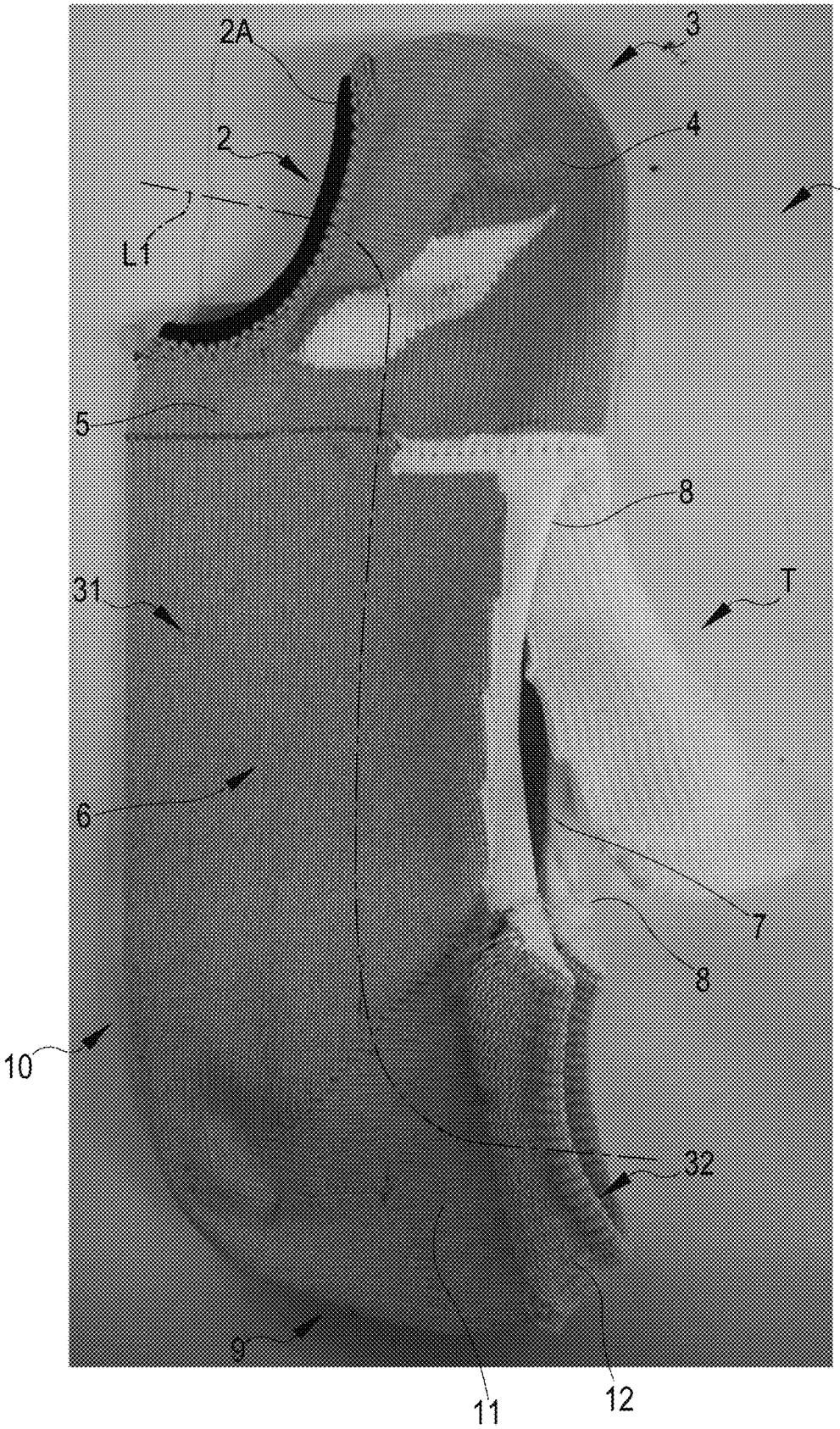
FIG. 1 shows a tubular textile article made by means of the process according to the present invention, in accordance with a first example of embodiment; in particular, it shows a side view of the textile article.

With reference to the figures mentioned, the numeral 1 globally designates a tubular textile article manufactured with a process according to the present invention.

In order to execute the process according to the present invention, a weft textile machine with at least one feed and with a needle holder supporting a plurality of needles, defining a needle bed, which can be actuated in a per se known manner in order to take the yarns supplied by this feed and form a fabric, can be preferably, though not exclusively, used. The needle holder can be rotated with respect to the feed and the feed is arranged near the needle holder. The needle holder can be actuated in a per se known manner with an alternating rotary motion with respect to the feed, i.e. according to two directions of motion opposed to one another, a forward and a backward motion, respectively, so as to make the needles in sequence face the feed and form a fabric both in the forward motion and in the backward motion of the needle holder with respect to the feed, as requested in intarsia designs.

From the point of view of knitting technology, the structure of the whole knitting machine and the operation of the needle holder (e.g. the cooperation between needles and yarns, etc.) are not described in detail since they are known in the technical field of the present invention.

The process of the present invention comprises a step of programming said textile machine so as to define a tubular textile article 1 to be made, which extends longitudinally in a seamless way starting from a first open end 2 and consisting of a plurality of stitch rows in succession.

The process then comprises a step of producing knitted fabric with the circular textile machine so as to manufacture the tubular knitted item 1, destined to represent an upper for footwear, according with the aforesaid programming step.

Let us consider first FIGS. 1-9, which show a first embodiment of a textile item according to the present invention.

The knitting step comprises a step A) of making the first open end 2, belonging to a first fabric 10 of the textile article, using a needle sector, or all the needles, of the needle bed; the first open end 2 is destined to represent a tip end of an upper.

The knitting step also comprises a step B) consisting in making a tip portion 3 of the first fabric 10, comprising a certain number of stitch rows and consisting of a stitch bulge 4 obtained using, in successive rows, first a decreasing number of needles per row and then similarly an increasing number of needles per row.

The tip portion 3 of the first fabric 10 is destined to represent a portion of the upper apt to accommodate or enclose the toe or part thereof.

It should be pointed out that, in the context of the present invention and claims, the stitch "bulges" can be obtained in various positions of the tubular item by using first an increasing number of needles per row and then a decreasing number of needles per row, or vice versa first a decreasing number of needles per row and then an increasing number of needles per row.

The knitting step can comprise an optional step C) consisting in making a bulge-free portion of complete tubular knitted fabric 5, along a longitudinal development L1 of the first fabric 10, comprising a respective number of stitch rows and wherein for each row the knitted fabric produced has a closed circular profile.

The knitting step comprises a step D) consisting in making a tab T, belonging to the first fabric 10 and destined to represent a portion of the upper suitable for enclosing or covering at least one portion of the instep.

The step D) of making a tab T involves interrupting the processing of the preceding rows, and continuing knitting using a needle sector or all the needles of the needle bed for a certain number of stitch rows, thus producing a knitted insert representing the tab T.

The knitting step comprises a step E) consisting in making a middle portion 6 of the first fabric 10, comprising a respective number of stitch rows and destined to represent a portion of the upper suitable for enclosing at least part of the sole and sides of the foot.

The middle portion 6 of the first fabric 10 has a longitudinal opening 7 (preferably without stitches), destined to be located on at least one portion of the instep (or neck of the foot), and two lateral margins 8 on the sides of the longitudinal opening 7.

The middle portion 6 of the first fabric 10 is made by using, in operation, a "respective needle sector" of the needle bed, comprising any number of needles up to a number including all the needles of the needle bed, for a certain number of stitch rows; the aforesaid "respective needle sector" can vary for each row comprised in the middle portion 6.

The knitting step comprises a step F) consisting in making an end portion 9 of the first fabric 10, comprising a certain number of stitch rows and consisting of one or more stitch bulges 11 each obtained using, in respective successive rows, first a decreasing number of needles per row and then similarly an increasing number of needles per row. The end portion 9 of the first fabric 10 is destined to represent a portion of the upper apt to accommodate or enclose the foot heel or part thereof.

Preferably, in steps D and E the tab T and the longitudinal opening 7 of the middle portion 6 are made such that they both have a substantially simultaneous longitudinal development, in a direction corresponding to a longitudinal development of the upper.

Preferably, steps D and E make the tab T and the middle portion 6, seamlessly with respect to each other, so that in the upper resulting from the tubular knitted item the tab is below the longitudinal opening 7.

Preferably, the knitting step entirely produces the unitary, single-piece tubular textile article 1, i.e. without separate parts.

Preferably, the steps are performed in succession such that processing is never interrupted between each step and the following one.

Preferably, steps D and E make the tab T and the middle portion 6, seamlessly with respect to each other, so that in the upper resulting from the tubular knitted item the tab T is at least partially covered or overhung by the lateral margins 8 of the middle portion 6.

Preferably, step A is the first step performed in the knitting step with the circular textile machine; in this case, the knitting of the textile article starts from the first open end 2.

As an alternative, though in an equally feasible manner and with the same result, step A is the last step performed in the knitting step with the circular textile machine; in this case, the knitting of the textile article ends from the first open end 2.

Preferably, the knitting step involves performing the steps in sequence in an order A-B-C (optional step)-D-E-F, seamlessly between each step and the following one.

As an alternative, the knitting step however involves performing the steps in sequence in an order F-E-D-C (optional step)-B-A, seamlessly between each step and the following one.

It should be pointed out that, in general, in the aforesaid sequences steps C are optional.

The process of the present invention is characterized by a sequence of reversible steps, i.e. the fabric may be manufactured starting from the first end 2 or ending with the first end 2; the sequence of steps and the knitting direction are set in the aforesaid step of programming the textile machine so as to define the tubular textile item 1 to be made.

Preferably, step A is performed with the textile machine operating in a continuous motion, i.e. producing rows of complete tubular knitted fabric through a continuous revolution of the needle holder in a given direction.

As an alternative, step A can be performed with the textile machine operating in an alternating motion, through an alternation of revolutions of the needle holder in one direction and in the opposite direction, producing rows of complete tubular knitted fabric.

Preferably, step A comprises a step of making an elastic edge 2A of the first open end 2.

Preferably, step B is performed with the textile machine operating in an alternating motion, so as to make the tip portion 3 of the first fabric, through an alternation of revolutions of the needle holder in one direction and in the opposite direction, using in each revolution a certain needle sector with a respective number of needles of the circular needle bed.

Preferably, step C is performed with the textile machine operating in a continuous motion, i.e. producing rows of complete tubular knitted fabric through a continuous revolution of the needle holder in a given direction.

Preferably, step D is performed with a textile machine operating in an alternating motion, to make the tab T, through an alternation of revolutions of the needle holder in one direction and in the opposite direction, selecting a needle sector of the circular needle bed for making the tab and using in each revolution a certain number or set of needles of such sector.

Preferably, in step D the number of needles used in each revolution with an alternating motion of the textile machine can be varied so as to shape the tab T along its longitudinal development, one row after another.

Preferably, in step D the sector of needles used in the alternating motion of the textile machine can comprise any preferred number of needles, within the sector selected for making the tab, up to a maximum of all the needles of the needle bed (if the sector selected for making the tab comprises all the needles of the needle bed).

In a possible embodiment, in step D only one needle sector of the needle bed is selected, and within such sector all the needles or only some of them may work, depending on the textile features desired for the tab T.

In a possible embodiment, step D ends when the desired length of the tab T is achieved, with the unloading of the needles used for making the tab itself, which ends with a free edge 41, i.e. not connected to other parts of the textile article, and the insert representing the tab consists of a single layer of fabric connected to the textile article (only) on the stitch made at the beginning of step D.

Figure 12:
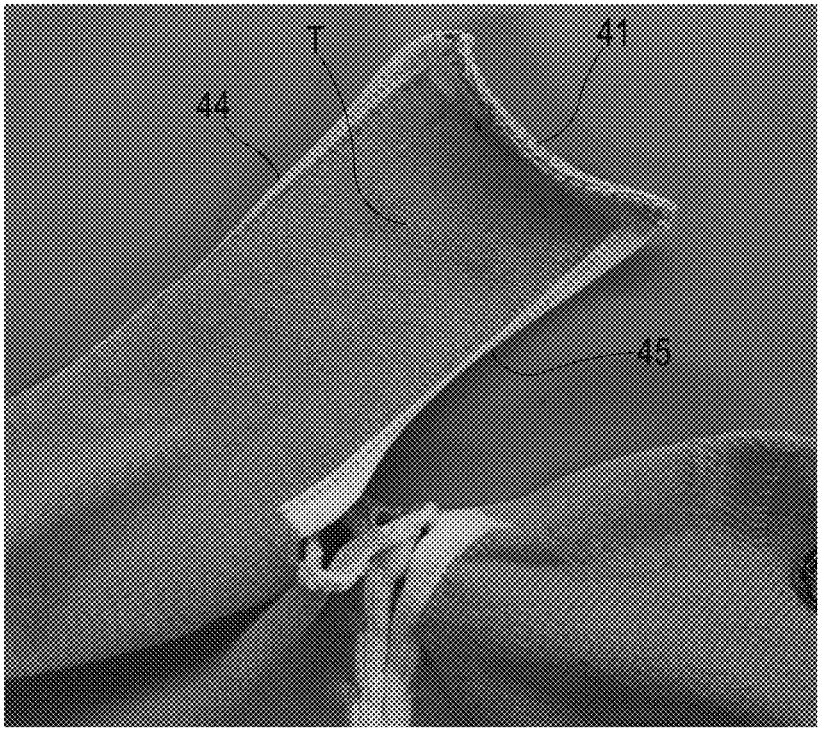
FIG. 12 shows a detail of the tubular article according to the present invention in particular, it shows the tab of the upper, obtained from the textile article, in accordance with a possible embodiment representing an alternative to the embodiments of FIGS. 5 and 6.

This embodiment is shown by way of example in FIG. 12.

Figure 5:
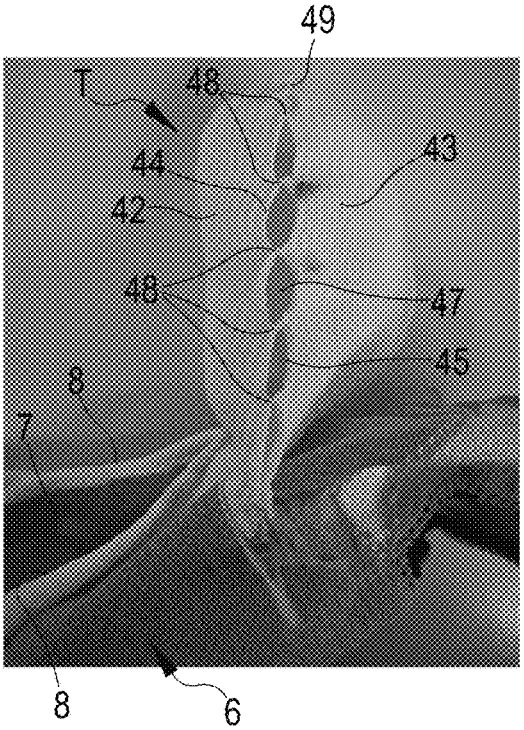
FIG. 5 shows a further detail of the tubular article of FIG. 1; in particular, it shows the tab of the upper, obtained from the textile article, in accordance with a possible embodiment according to the present invention.
Figure 6:
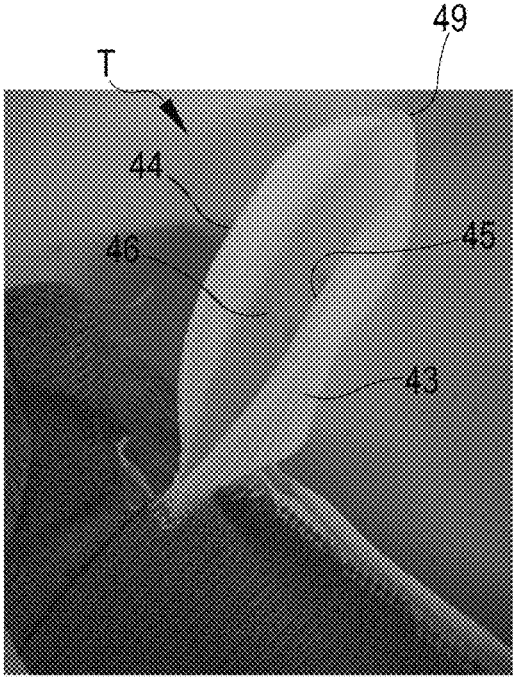
FIG. 6 shows a detail of the tubular article according to the present invention in particular, it shows the tab of the upper, obtained from the textile article, in accordance with a further possible embodiment representing an alternative to the embodiment of FIG. 5.
Figure 7:
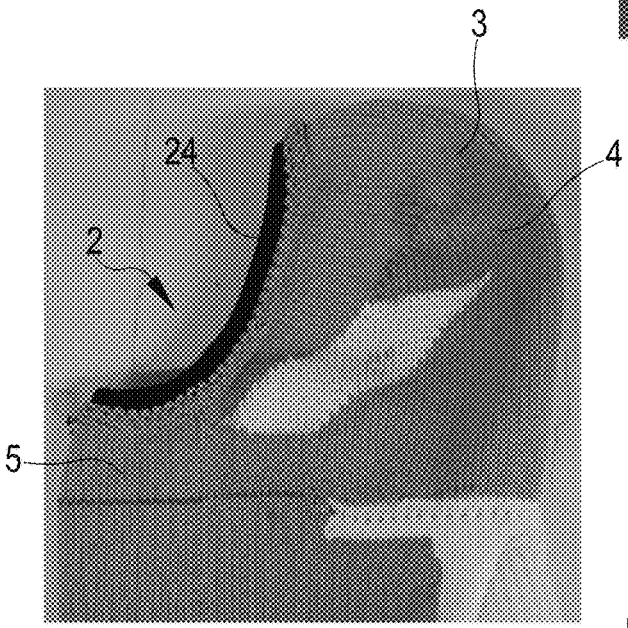
FIG. 7 shows a further detail of the tubular article of FIG. 1; in particular, it shows an initial portion of the textile article.

In a further possible embodiment, as an alternative to the previous one and shown by way of example in FIGS. 5 and 6, step D:

- starts by selecting, with an alternating motion, a sector of needles used for making the tab T, and within such sector a certain number of needles is kept in the idle position for the entire processing of the tab, which is made with the remaining needles of said sector;
- continues by longitudinally developing the tab T in a continuous way, for an extension which is twice its final extension;
- ends by resuming the processing by the above-mentioned needles previously kept in the idle position, so that the last stitch row made in step D is located on the first stitch row made in step D.

In this way, the tab consists of a double fabric, that is, two layers of fabric 42 and 43 folded onto each other along a fold line 49, the latter substantially corresponding to the stitch made halfway through step D.

Basically, step D produces a tab T starting and ending in the same place as the textile item 1, and once the tab is flattened, it thus has a double fabric structure, whose length corresponds to half of the longitudinal extension of the stitch made in step D.

Preferably, making the double fabric tab T provides for the textile processing in step D to end with the same number of needles with which step D itself started.

Preferably, step D involves textile processing known in the art with the term "button", which allows to start and end the double fabric tab T in the same position, seamlessly with the rest of the textile article, i.e. with the fabric made in steps C, or B, and E.

Preferably, in step D the step of interrupting the processing involves stopping a certain number of needles which are contiguous in operation in the preceding rows (belonging to the knitted fabric produced in step C, or B if C is not present, or in step E, depending on the knitting direction and to the sequence of steps as per textile machine programming).

Preferably, in step D the step of continuing knitting involves continuing only with one needle sector of the needle bed.

Preferably, as shown by way of example in FIG. 6, if step D makes a tab T consisting of a double fabric (42, 43), the tab T has two free lateral edges 44, 45, each extending along the entire longitudinal development of the double fabric tab T. These two lateral edges 44 and 45 can be linear or shaped and the double fabric tab T has two lateral opening 46, 47 on the two lateral edges.

In an alternative embodiment, shown by way of example in FIG. 5, if step D makes a tab T consisting of a double fabric 42, 43, the tab T has the two lateral edges 44, 45 each extending along the entire longitudinal development of the double fabric tab, and moreover:

- the two lateral edges 44, 45 are made for a first half of the longitudinal extension of the tab T, i.e. up to the fold line 49 by inserting one or more scales, preferably a plurality of scales, i.e. reducing the number of needles in operation and leaving the excluded needles, in the idle position, with the knitted fabric retained in the needle head;
- the two lateral edges 44, 45 are made for a second half of the longitudinal extension of the tab T, i.e. beyond the fold line 49, gradually resuming the above-mentioned scales, i.e. increasing the number of needles in operation and reconnecting the knitted stitches of the needles previously excluded to the knitted fabric made in the second half of the lateral edges 44 and 45.

Thus a double fabric tab T is obtained, wherein each of the two lateral edges 44, 45 has ties 48 between its first half and its second half, along the longitudinal development, so that on the lateral edges 44 and 45 of the double fabric tab there are one or more closing stitches 48, each corresponding to a respective knitted fabric scale.

Preferably, step D is performed seamlessly with respect to step B, i.e. the tab T is made from the tip portion 3 of the first fabric 10 without variations in the knitted structure.

Preferably, step E is performed with the textile machine operating in an alternating motion, so as to make the middle portion 6 of the first fabric 10, through an alternation of revolutions of the needle holder in one direction and in the opposite direction, using in each revolution a certain needle sector with a respective number of needles of the circular needle bed.

Preferably, in step E the number of needles used in each revolution with an alternating motion of the textile machine can be varied so as to shape the middle portion 6 of the first fabric and the longitudinal opening 7 (preferably without stitches), one row after another.

Preferably, in step E the number of needles used in each revolution with an alternating motion of the textile machine can be any number of needles up to a maximum of all the needles of the needle bed.

In a possible embodiment, in step E only one needle sector of the needle bed can be used, and within such section all the needles or only some of them may work, depending on the textile featured desired for the middle portion of the first fabric.

Step E can provide for a progressive variation in the number of needles used in making the knitted fabric, in order to give the above-mentioned longitudinal opening 7 of the middle portion 6 of the first fabric 10 a "V" shape.

Preferably, this progressive variation in the number of needles in step E can be:

- a progressive decrease in the number of needles if the median portion 6 of the first fabric 10 is made following step D and before step F, i.e. by first making a final vertex of the longitudinal opening 7;
- a progressive increase in the number of needles if the median portion 6 of the first fabric 10 is made following step F and before step D, i.e. by lastly making a final vertex of the longitudinal opening 7.

In other words, the increase or decrease of the needles when making the median portion depends on the direction in which the textile item is manufactured, i.e. on the sequence of the knitting steps.

Preferably, step F is performed with the textile machine operating in an alternating motion, so as to make the end portion 9 of the first fabric 10, through an alternation of revolutions of the needle holder in one direction and in the opposite direction, using in each revolution a certain needle sector with a respective number of needles of the circular needle bed.

Figure 2:
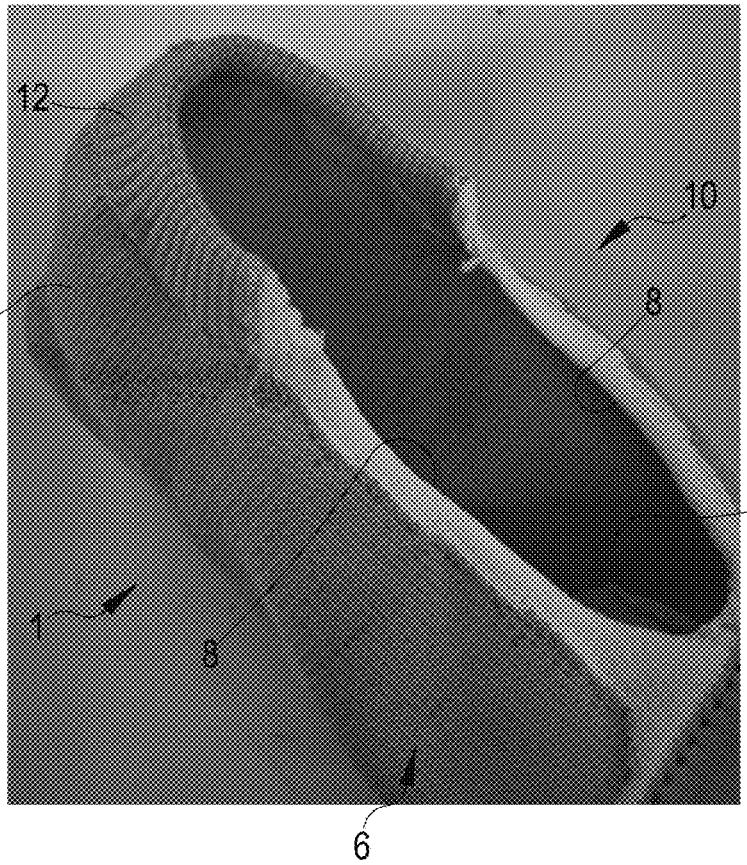
FIG. 2 shows a detail of the tubular article of FIG. 1; in particular, it shows an upper, partially lateral portion of the textile article.
Figure 3:
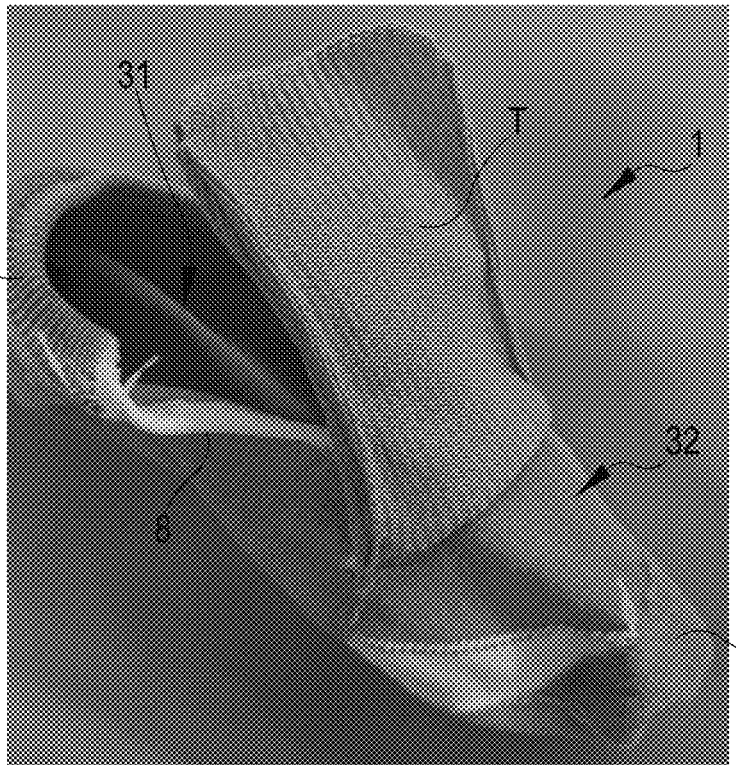
FIG. 3 shows the tubular article of FIG. 1 turned inside out, i.e. with the inside to be seen outside; the inner side of the fabric shown in FIG. 3 is opposed to the outer side that can be seen in FIG. 1.
Figure 4:
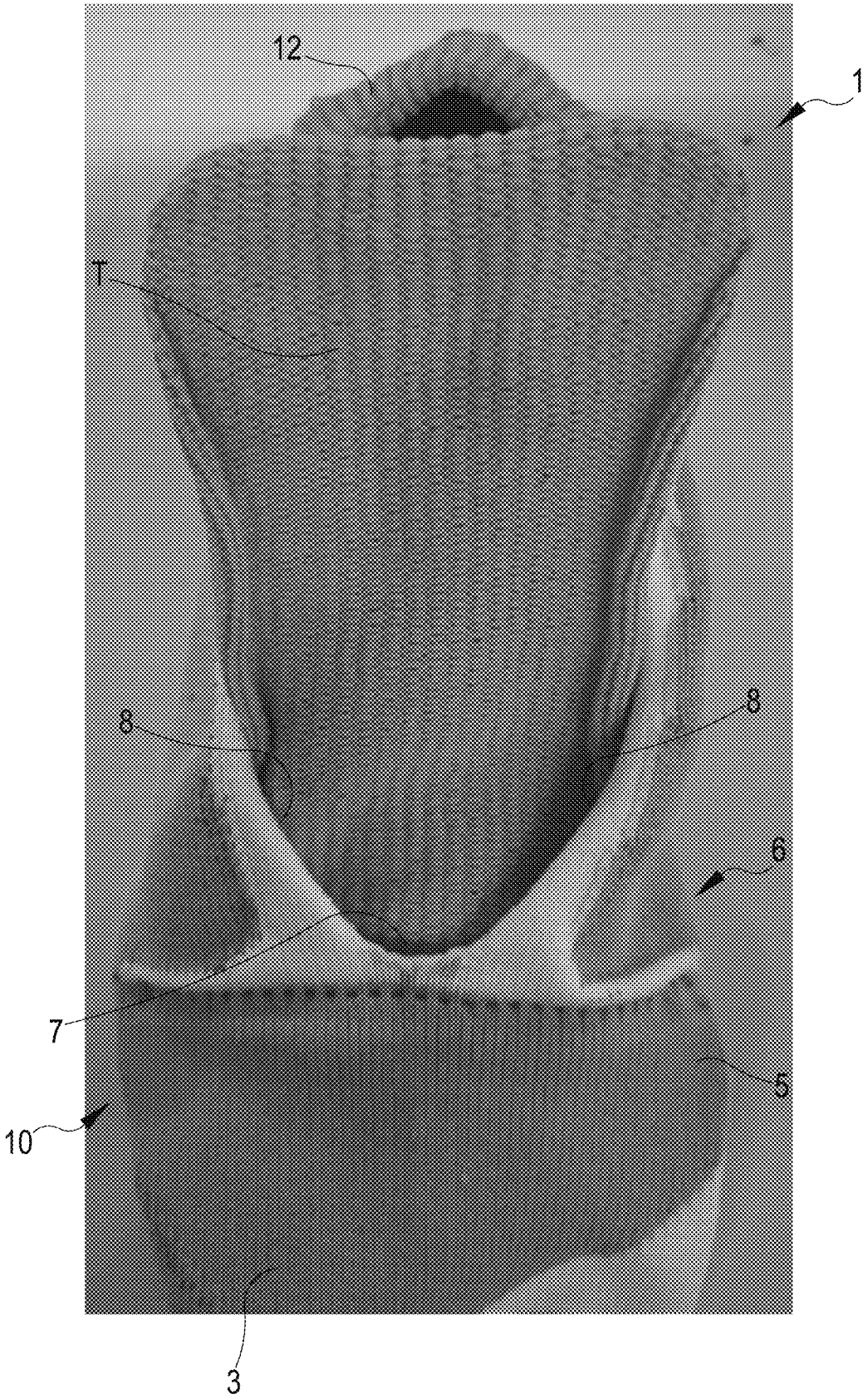
FIG. 4 shows a further detail of the tubular article of FIG. 1; in particular, it shows an upper front portion of the textile article.

Preferably, as shown in FIGS. 1-3, the end portion 9 of the first fabric 10 ends, at the end of step F, with an open stitch, i.e. with a stitch without a closed circular profile.

Preferably, step F can comprise a step of making an edge 12 of the end portion 9 of the first fabric 10.

Preferably, in the transition from step D to step E a replacement of the needles being used takes place, i.e. in step D, needles belonging to a needle sector are used to make the tab T close to the longitudinal opening 7 made in step E and/or belonging to a needle sector not used in step E during the definition of the longitudinal opening 7 of the middle portion 6 of the first fabric 10. Thus the tab T is caused to be at least partially overlapped by the lateral margins 8 of the middle portion 6, and vice versa the longitudinal opening 7 of the middle portion 6 shows at least partially, underneath the same, the tab T.

Preferably, if making the middle portion 6 of the first fabric 10 in step E does not affect all the needles in the needle bed, one or more of the needles not used, in the definition of the longitudinal opening 7, correspond to needles that contribute in step D to making the tab T, or that belong to the needle sector selected for making the tab T.

Preferably, if making the tab T in step D has not affected all the needles in the needle bed, in step E, for making the middle portion 6 of the first fabric 10, at least some needles belonging to the sector of needles not selected in step D for making the tab T are used.

These alternating needles used in steps D and E can be observed in the graphical representation of FIG. 9, which shall be explained below.

Preferably, in the upper resulting from the tubular item 1, the tab T is not completely covered and therefore accessible from outside (in particular from above) on the longitudinal opening 7 of the middle portion 6, in the area between the two margins 8 of the longitudinal opening. Preferably, the tab T is covered laterally by the two margins 8 of the longitudinal opening and not covered in its central portion (on the longitudinal opening 7).

Figure 8:
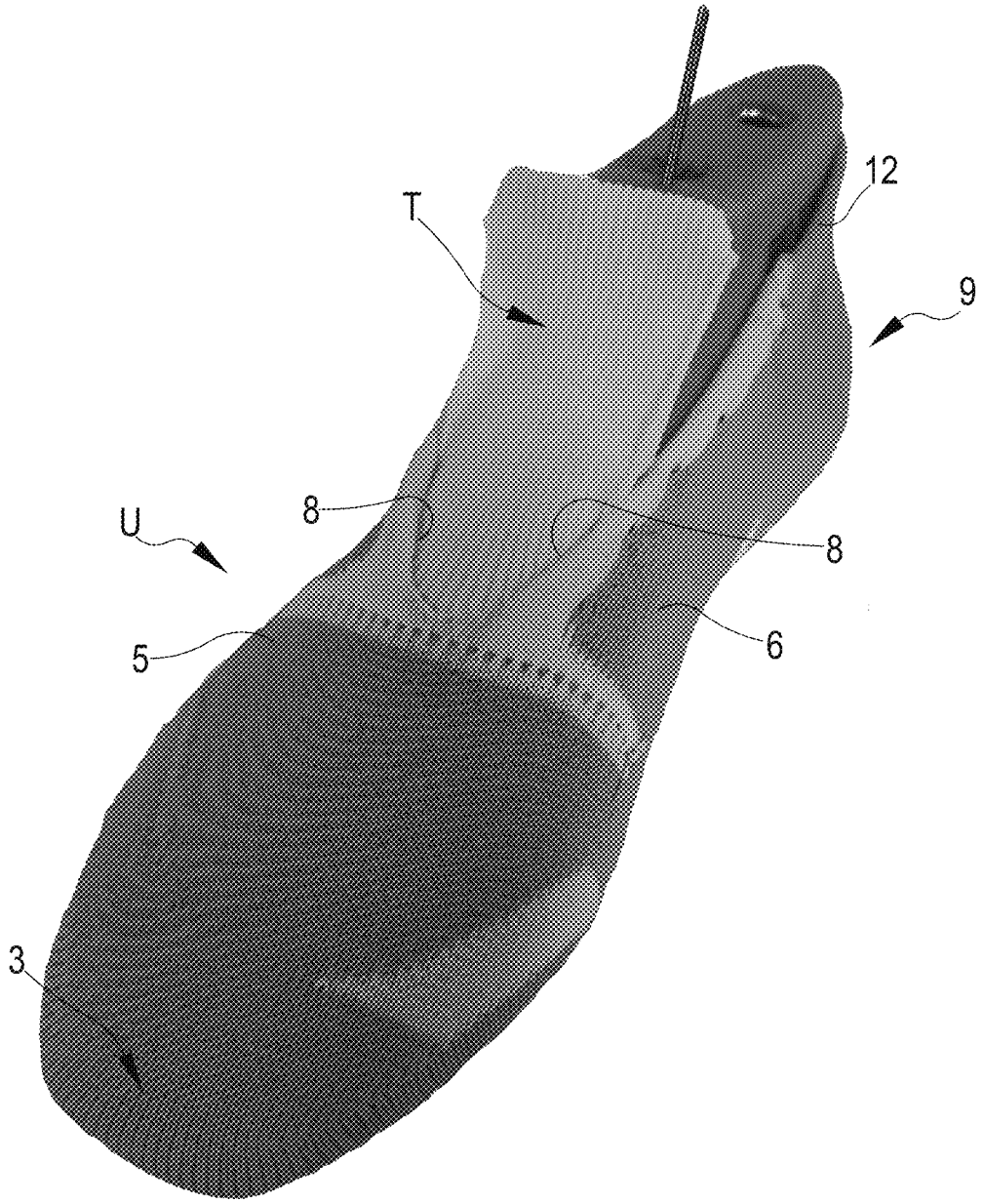
FIG. 8 shows the tubular textile article of FIG. 1 representing a shoe upper.

FIG. 8 shows by way of example an upper U made with the tubular textile item 1 of FIGS. 1-7; the three-dimensional shape taken by the textile item 1 can be observed, as obtained by fitting the upper onto a form or stiffening the upper e.g. by means of a thermoforming process or by the addition of fixing materials. The upper U corresponds anyway to the textile article 1.

Preferably, the longitudinal development of the upper U matches the length development of the user's foot and further corresponds to the longitudinal development L1 of the first fabric 10.

Figure 9:
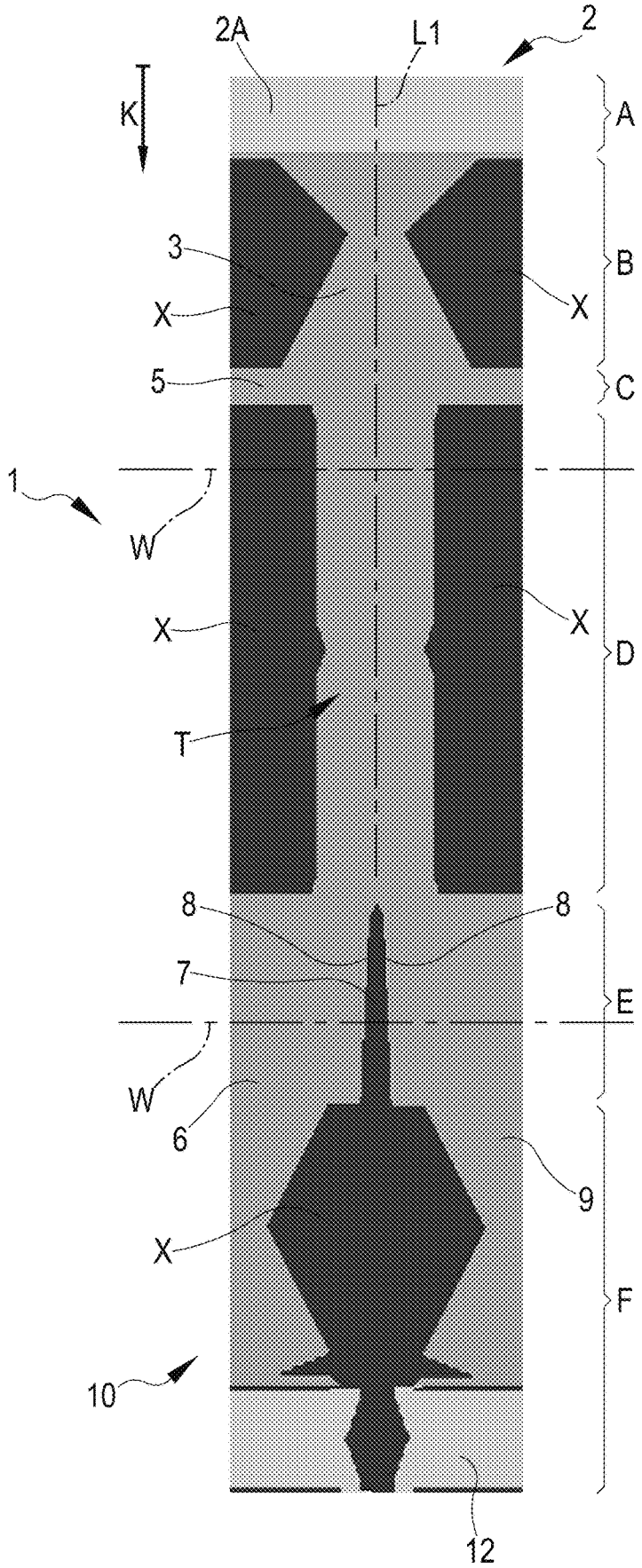
FIG. 9 schematically shows by way of example the graphic representation of a processing program to be executed on a circular textile machine so as to implement the process according to the present invention and manufacture a tubular textile article according to the present invention and as shown in FIG. 1.

The graphical representation of FIG. 9 is disclosed below, it schematically shows an example of a processing program to be executed on a circular weft knitting machine so as to implement the process according to the present invention and manufacture a tubular textile item as shown in FIGS. 1-8, i.e. comprising the first fabric 10 only.

First of all, the representation shows the tubular item 1 stretched as if it had been cut along a longitudinal axis, corresponding to the knitting direction (indicated by arrow K), and therefore open; each horizontal line corresponds to a stitch row (lines W indicate by way of example a respective row).

It should be observed that, by way of example, the representation of FIG. 9 can also correspond to one longitudinal portion of the tubular item only, which can then continue with further stitch rows on both upper and lower ends. For instance, the tubular item can be manufactured by the knitting machine in a continuous manner, and then be divided by cutting into several tubular items 1.

Black areas (indicated with X) represent needle sections which, in given stitch rows, are non-operating: this is possible in particular thanks to the knitting features of an intarsia machine, which allows to interrupt stitch formation on given selected needles, and to resume it later. The shape of the black areas can be obtained by progressively resuming or excluding working on the needles in several successive courses. It should be observed that black areas do not result in "holes" in the tubular item, but represent sections of needles that do not produce fabric: this means that, where a black area is present, the adjacent areas are however in contact with each other so as to ensure continuity in stitch formation, but in the courses containing black areas less stitches are formed, which result in section tightening.

The exclusion of given needle sections, which creates the black areas of FIG. 9, enables to give a three-dimensional shape to the tubular item, i.e. to create pockets, bulges and "protrusions" in the tubular item, which thus is not perfectly cylindrical in its whole longitudinal extension but has a precise shape that will cause the three-dimensional shape of the upper U obtained from the textile item 1.

The diagram in FIG. 9 indicates side by side the various knitting steps (A, B, C, D, E, F): stitch rows associated to each step belong to the knitted portion of the textile item produced in the respective step.

Moreover, the diagram indicates the knitted structures obtained in the various steps and disclosed above: the first end 2, the elastic edge 2A, the tip portion 3, the portion of complete tubular knitted fabric 5, the tab T, the middle portion 6, the longitudinal opening 7, the lateral margins 8, the end portion 9, the edge 12.

The diagram further points out the variation in the number of needles in step E so as to give the longitudinal opening 7 a "V" shape.

It should be observed that the shape of the black areas, and thus of the needle sections used, allows to obtain the bulges to be seen in FIGS. 1-8. These bulges are precisely designed and programmed so as to obtain a correct shape of the upper U.

Let us consider now FIGS. 10-20, which show a second embodiment of a textile item 1 according to the present invention.

First of all, this item comprises the first fabric 10 as already described above, and made with the steps A, B, C, D, E and F.

Besides this first fabric 10, the step of programming the textile machine so as to define the tubular textile item 1 involves making a second fabric 20, too, seamlessly with the first fabric 10, so as to obtained a "double fabric" upper.

The knitting step then comprises a step F') consisting in making, seamlessly with the end portion 9 of the first fabric 10, made in step F, an initial portion 29 of the second fabric 20 of the textile article 1, extending longitudinally in a seamless way with respect to the first fabric 10.

The initial portion 29 of the second fabric 20 comprises a certain number of stitch rows and consists of one or more stitch bulges 21, each obtained using, in respective successive rows, first a decreasing number of needles per row and then similarly an increasing number of needles per row. The initial portion 29 of the second fabric 20 is destined to represent a portion of the upper U apt to accommodate or enclose the foot heel or part thereof.

The knitting step can further comprise a step E') consisting in making a middle portion 26 of the second fabric 20, comprising a respective number of stitch rows and destined to represent a portion of the upper U suitable for enclosing at least part of the sole and sides of the foot. The middle portion 26 of the second fabric 20 has a longitudinal opening 27 (preferably without stitches), destined to be located on at least one portion of the instep/neck of the foot, and two respective lateral margins 28 on the sides of the longitudinal opening 27. The middle portion 26 of the second fabric 20 is made by using, in operation, a respective needle sector of the needle bed, comprising any number of needles up to a number including all the needles of the needle bed, for a certain number of stitch rows; the respective needle sector can vary for each row comprised in the middle portion 26.

The knitting step can further comprise an optional step C') consisting in making a bulge-free portion of complete tubular knitted fabric 25, along a longitudinal development L2 of the second fabric 20, comprising a respective number of stitch rows and wherein for each row the knitted fabric produced has a closed circular profile.

The knitting step can further comprise a step B') consisting in making a tip portion 23 of the second fabric 20, comprising a certain number of stitch rows and consisting of a stitch bulge 24 obtained using, in successive rows, first a decreasing number of needles per row and then similarly an increasing number of needles per row. The tip portion 23 of the second fabric 20 is destined to represent a portion of the upper U apt to accommodate or enclose the toe or part thereof.

The knitting step can further comprise a step A') of making a second open end 22 of the textile item 1, corresponding to an end of the second fabric, using a needle sector, or all the needles, of the needle bed; the second open end 22 is destined to represent a tip end of the upper.

Preferably, longitudinal development L of the textile article 1 means the development thereof along the knitting direction of the textile machine; in this sense the longitudinal development L has a curvilinear progress depending on the type of knitted fabric made and on the needles used for each row.

Preferably, the second open end 22 of the textile item 1 is longitudinally opposed to the first open end 2.

Preferably, the tubular textile article 1 develops seamlessly between the first end 2 and the second end 22.

Preferably, the first open end 2 and the second open end 22 of the textile item 1 represent a beginning and an end, or vice versa an end and a beginning, of the step of knitting with the circular textile machine and in accordance with the aforesaid programming step.

Figure 10:
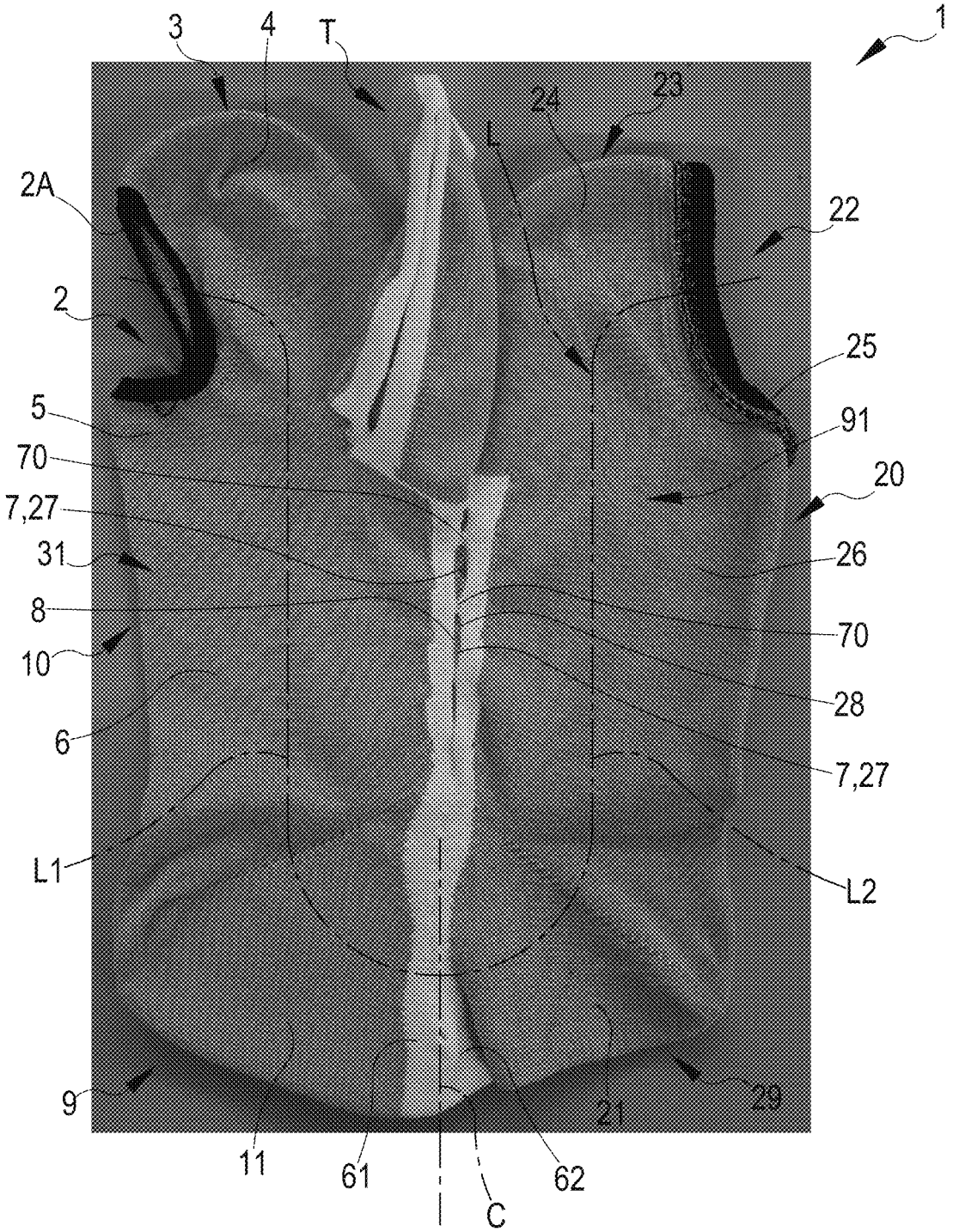
FIG. 10 shows a tubular textile article made by means of the process according to the present invention, in accordance with a second example of embodiment; in particular, it shows a side view of the textile article.
Figure 11:
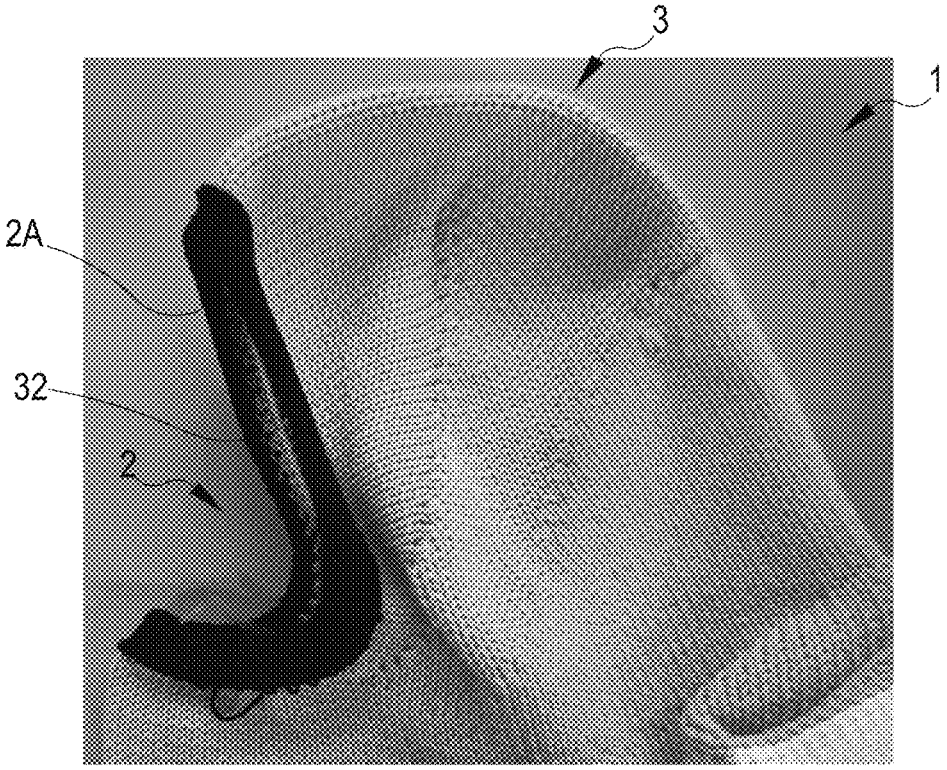
FIG. 11 shows a detail of the tubular article of FIG. 10; in particular, it shows an initial portion of the textile article.

It should be observed, in particular in FIG. 10, that the longitudinal development L2 of the second fabric 20 continues seamlessly with respect to the longitudinal development L1 of the first fabric 10 along the knitting direction.

Preferably, the second fabric 20 does not include knitted portions or steps configured for defining a tab as the one made, in the first fabric 10, in step D; in other words, the second fabric does not include a tab overhung by the lateral margins of the middle portion (partially covering the foot neck). The second fabric may however be provided with other knitted inserts rising in certain positions.

Preferably, the second fabric 20 is symmetrical and structurally "specular", with the exception of the tab, with respect to the first fabric 10, i.e. the second fabric comprises the same portions as the first fabric made with the same step, with the exception of the tab. In particular:

- the first open end 2 made in step A and the second open end 22 made in step A' are corresponding to one another, both open ends being destined to represent, or to be located at, one tip end of an upper U;
- the tip portion 3 of the first fabric 10 made in step B and the tip portion 23 of the second fabric 20 made in step B' are corresponding to one another, both tip portions being destined to represent, or be located at, one portion of the upper U suitable for accommodating or enclosing the toe or part thereof;
- the portion of complete tubular knitted fabric 5 of the first fabric 10 made in step C and the portion of complete tubular knitted fabric 25 of the second fabric 20 made in step C' are corresponding to one another;
- the middle portion 6 of the first fabric 10 made in step E and the middle portion 26 of the second fabric 20 made in step E' are corresponding to one another, and in particular have corresponding longitudinal openings 7 and 27 (preferably without stitches), destined to be located at a same portion of the instep/neck of the foot, and corresponding lateral margins 8 and 28 on the sides of the respective longitudinal opening; both middle portions 6 and 26 are destined to represent, or to be located at, one portion of the upper U suitable for enclosing at least part of the sole and the sides of the foot;
- the end portion 9 of the first fabric 10 made in step F and the initial portion 29 of the second fabric 20 made in step F' are corresponding to one another, both tip portions being destined to represent, or be located at, one portion of the upper U suitable for accommodating or enclosing the heel of the foot or part thereof.

It should be pointed out that the wording "corresponding to one another" for matching portions of the first and second fabric, means that the portions of the first and second fabric are shaped in the same or similar manner and/or have at least partially the same knitted structure and/or are made so as to match each other and create a correct double fabric structure.

Preferably, the second fabric 20 is made in the "opposite" direction with respect to the first fabric 10, i.e. the second fabric 20 develops from the end of the end portion 9 of the first fabric 10 in a specular and seamless manner, starting from its initial portion 29.

Preferably, the second fabric 20 is made with the same steps in reversed order with respect to the first fabric 10, except for step D which is not included for the second fabric.

Preferable, the second fabric 20 is made seamlessly with the first fabric 10, the tubular textile item 1 being unitary and single-piece, i.e. without separate parts.

Preferably, step A' is the last step performed in the knitting step with the circular textile machine, the knitting of the textile article 1 ending with the second open end 22 of the textile article, belonging to the second fabric 20.

In an alternative and wholly equivalent manner, step A' can be the first step performed in the knitting step with the circular textile machine, the knitting of said textile article starting from the second open end 22 of the textile article, belonging to the second fabric 20.

Preferably, the knitting step involves performing the steps in sequence in an order A-B-C-D-E-F-F'-E'-C'-B'-A', seamlessly between each step and the following one.

As an alternative, though in an equally feasible manner and with the same result, the knitting step can however involve performing the steps in sequence in an order A'-B'-C'-E'-F'-F-E-D-C-B-A, seamlessly between each step and the following one.

In the above-mentioned sequences steps C and C' are optional.

The operation of the textile machine, either with a continuous or alternating motion, in steps A', B', C', E', F' preferably corresponds to the above description of steps A, B, C, E, F.

It should be pointed out that in the present description, the first fabric of the textile article is the one comprising the tab T, whereas the second fabric is the one without the tab. Basically, it does not matter which of the two fabrics is produced first: the first fabric 10 is always the one comprising the tab made in step D.

Preferably the method may comprise, when making the second fabric 20, even only one or some of said steps F', E', C', B', A'.

Figure 13:
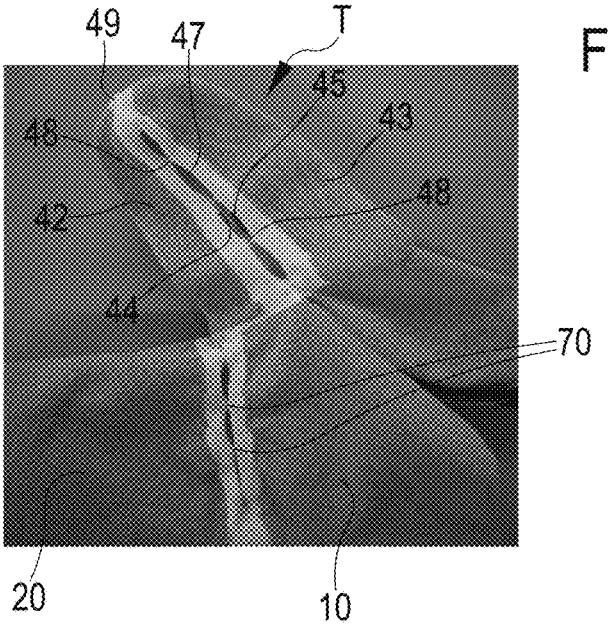
FIG. 13 shows a further detail of the tubular article of FIG. 10; in particular, it shows the tab of the upper, obtained from the textile article, in accordance with a possible embodiment according to the present invention.
Figure 14:
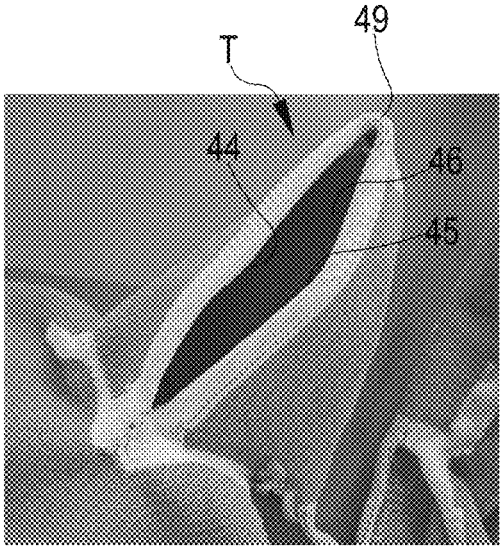
FIG. 14 shows a detail of the tubular article according to the present invention in particular, it shows the tab of the upper, obtained from the textile article, in accordance with a further possible embodiment representing an alternative to the embodiment of FIG. 13.
Figure 15:
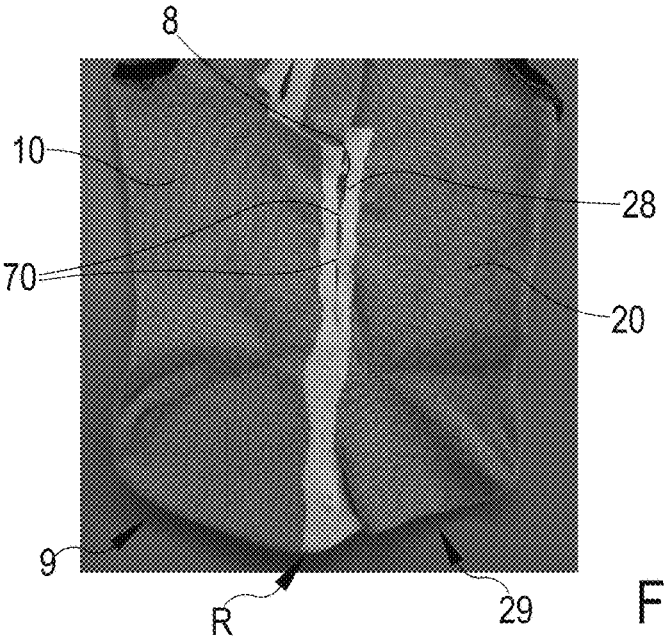
FIG. 15 shows a detail of the tubular item of FIG. 10.
Figure 19:
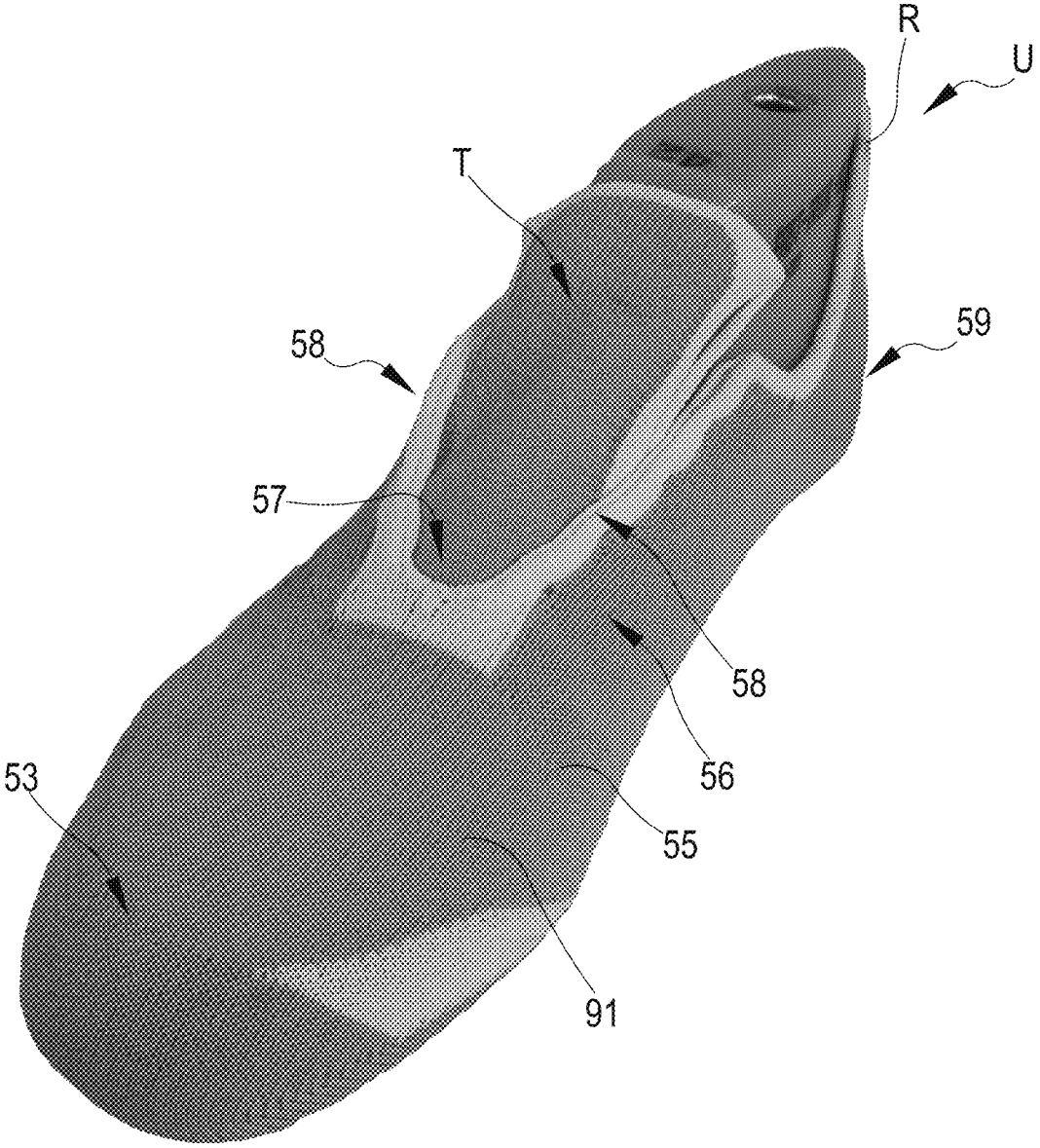
FIG. 19 shows the tubular textile article of FIG. 10 representing a shoe upper.

The tab T shown for the second embodiment in FIGS. 13-14, i.e. the double fabric upper U, is preferably identical to the tab T shown in FIGS. 5 and 6.

Preferably, the first fabric 10 comprises an external surface 31 and an internal surface 32, and the second fabric 20 comprises a respective external surface 91 and a respective internal surface 92, wherein the external surface 31 of the first fabric 10 is connected to, and continues seamlessly in, the external surface 91 of the second fabric 20, and the internal surface 32 of the first fabric is connected to, and continues seamlessly in, the internal surface 92 of the second fabric.

Surface (either internal or external) of the first or second fabric means a face or side of the fabric itself; for each fabric the internal surface is opposed to the external surface.

Preferably, the method comprises, following the knitting step with the circular textile machine to make the tubular textile article 1, a step of manipulating and folding the textile article to make an upper U, and in such a way that:

- the first fabric 10, that is the fabric comprising the tab T, is folded inside the second fabric 20, along a folding (or turning) profile;
- the inside 32 of the first fabric 10 contacts the inside 92 of the second fabric 20, both—with the upper in use—without contacting the user's foot or the outside of the upper;
- the outside 31 of the first fabric 10 is folded inside the second fabric 20, so that the outside 31 of the first fabric is, with the upper in use, facing or directed to or in contact with the user's foot;
- the outside 91 of the second fabric 20 represents—with the upper in use—an external surface of the upper U.

In one aspect, the first fabric 10, or better the one provided with the tab T, is the one destined to be folded inside the second fabric 20.

In one aspect, following the step of manipulating and folding the textile article 1, the portions representing the second fabric match and contact the corresponding portions representing the first fabric, and in particular:

- the first open end 2 made in step A matches the second open end 22 made in step A', obtaining a double-layer open end;

the tip portion 3 of the first fabric 10 made in step B matches the tip portion 23 of the second fabric 20 made in step B', obtaining a double-layer tip portion 53;

the portion of complete tubular knitted fabric 5 of the first fabric made in step C matches the portion of complete tubular knitted fabric 25 of the second fabric made in step C', obtaining a double-layer complete tubular knitted fabric 55;

the middle portion 6 of the first fabric 10 made in step E matches the middle portion 26 of the second fabric 20 made in step E', obtaining a double-layer middle portion 56;

the longitudinal opening 7 of the first fabric 10 matches the longitudinal opening 27 of the second fabric 20, obtaining a double-layer longitudinal opening 57;

the lateral margins 8 of the middle portion 6 of the first fabric match the lateral margins 28 of the middle portion 26 of the second fabric, obtaining double-layer lateral margins 58;

the end portion 9 of the first fabric 10 made in step F matches the initial portion 29 of the second fabric 20 made in step F', obtaining a double-layer end portion 59.

Preferably, step F involves making, at the end of the end portion of the first fabric, an end zone 61 of the first fabric 10, destined to represent a portion of the upper U apt to enclose the user's ankle or part thereof, and step F' involves making, at the beginning of the initial portion 29 of the second fabric, a respective end zone 62 of the second fabric 20, destined to represent a portion of the upper apt to enclose the user's ankle or part of it. Preferably, the end zone 61 the first fabric made in step F and the end zone 62 of the second fabric made in step F' are corresponding to one another.

Preferably, the end zone 62 of the second fabric, made in step F', develops seamlessly with respect to the end zone 61 of the first fabric, made in step F.

Preferably, the end zone 61 of the first fabric 10 made in step F and the end zone 62 of the second fabric 20 made in step F' are in contact with each other on, i.e. they have in common, a folding curve C belonging to said folding profile, on which the first fabric 10 is folded inside the second fabric 20.

Preferably, folding the first fabric 10 inside the second fabric 20 on the folding curve C generates a rear insert R of the double fabric upper U, apt to enclose from behind the user's ankle or part thereof.

Preferably, the rear insert R of the upper U is configured for being grasped when introducing the foot into the upper so as to simplify such operation.

Preferably, the rear insert R of the upper U is configured for enclosing or protecting the user's ankle, or for increasing the comfort of such portion of the upper.

Preferably, the folding curve C separates the first fabric 10 from the second fabric 20, which is considered as a global longitudinal development L of the tubular item corresponding to the manufacturing direction of the item itself.

Preferably, the end zone 61 of the first fabric 10 made in step F and the end zone 62 of the second fabric 20 made in step F' represent together an intermediate portion of the tubular textile item, along a manufacturing direction of the item itself.

Preferably, the method may comprise, after the step of manipulating and folding the textile article, a step of applying a sole below a portion of the textile article, so as to make a shoe provided with the upper U.

Preferably, following the step of manipulating and folding the textile article 1 so as to make an upper U, the tab T reaches below both longitudinal openings 7 and 27 of the first 10 and second fabric 20 and is at least partially covered or overhung by both pairs of lateral margins 8 and 28 of the middle portions 6 and 26 of the first and second fabric.

The upper U can comprise the first fabric 10 only, thus being a single layer upper, as shown in FIGS. 1-9.

According to a different embodiment, the upper U can comprise the first 10 and the second fabric 20, thus being a double layer upper U, as shown in FIGS. 10-20.

Manipulating the textile article so as to complete the assembly of the double fabric (or double layer) upper involves that the first fabric, comprising the tab T, is inserted into the second fabric, without the tab, so that the tab belonging to the first fabric is at least partially below the double layer longitudinal opening 57.

Preferably the tab T protrudes (i.e. develops) from the outside 31 of the first fabric 10, which then becomes the inside of the upper (facing the user's foot, possibly also in contact with the user's foot).

Preferably, in case of a single fabric (or single layer) upper U the tab T is covered by the lateral margins 8 of the middle portion 6 of the first fabric 10. in particular contacting the inside 32 of the first fabric.

As an alternative, in case of a double fabric (or double layer) upper U the tab T is covered by the lateral margins 8 and 28 of the middle portions 6 and 26 both of the first fabric 10 and of the second fabric 20, in particular contacting the outside 31 of the first fabric.

In a possible embodiment, in case of a textile item 1 comprising the first 10 and the second fabric 20:

in step E, the two lateral margins 8 of the longitudinal opening 7 of the first fabric 10 are made by inserting one or more scales, preferably a plurality of scales, i.e. reducing the number of needles in operation and leaving the excluded needles, in the idle position, with the knitted fabric retained in the needle head;

subsequently, in step E' the two lateral margins 28 of the longitudinal opening 27 of the second fabric 20 are made by progressively resuming the above-mentioned scales introduced in step E, i.e. increasing the number of needles in operation and reconnecting the knitted stitches of the needles previously excluded to the knitted fabric made in step E;

thus obtaining a double fabric middle portion 56 wherein each of the two lateral margins 8 of the first fabric 10 has ties 70 to the corresponding lateral margin 28 of the second fabric 20, along the longitudinal development of the margins, such that—once the tubular article has been manipulated to make a double fabric upper U—the pairs of corresponding lateral margins of the first and second fabrics have one or more closing stitches 70, each corresponding to a respective knitted fabric scale.

Basically, the ties are between the middle portions 6 and 26 of the first fabric 10 and of the second fabric 20 are obtained by stopping some needles during step E and "waiting" for step E' before being resumed to operation.

Ties are made between the first fabric, which becomes the inside of the upper, and the second fabric, which becomes the outside of the upper.

An example of ties 70 in a double fabric upper U can be seen in particular in FIGS. 10 and 15-17.

Preferably, the ties 70 are positioned on the folding profile between the first and second fabric, that is, along the line where the first fabric is folded inside the second fabric.

It should be pointed out that ties 70 make it easier, during manipulation, to guide and fold the first fabric 10 into the second fabric 20 and to match the corresponding lateral margins of the longitudinal opening of the first and second fabric, so as to complete and make the double layer longitudinal opening 57.

Preferably, if the knitting step for making the tubular textile article involves making first the second fabric 20 and then the first fabric 10, the scales, i.e. the reduction of the number of needles in operation and leaving the excluded needles with the knitted fabric retained, takes place in step E', whereas the progressive resumption of the scales, i.e. the increase of the number of needles in operation connecting back to the knitted fabric the stitches of needles previously excluded, takes place in step E.

It should be pointed out that in FIG. 16 the tab cannot be seen since it has been folded into the textile item 1, which has already been manipulated and folded so as to make an upper U, thus better showing the shape of the double layer longitudinal opening 57.

Preferably, suitable holes configured for allowing the passage of shoelaces for the upper U can be provided on the lateral margins 8 and 28 of the first and of the second fabric. These holes can be seen in particular in FIG. 16. The shoelaces (not shown, e.g. of known type) can extend transversally to the longitudinal opening and above the tab T. The shoelaces connect the opposed lateral margins of the double layer longitudinal opening 57.

In a possible embodiment, the method may include a step of closing the first open end 2 of the first fabric 10. Preferably, the step of closing the first end can take place directly on or onboard the textile machine producing the textile item, before the item is unloaded from the textile machine, or after unloading the textile item.

In a possible embodiment, the method may include a step of closing the second open end 22 of the second fabric 20.

Preferably, the step of closing the second end can take place directly on or onboard the textile machine producing the textile item, before the item is unloaded from the textile machine, or after unloading the textile item.

Preferably, the closing step can take place for instance by sewing or bonding or gluing.

In accordance with what is shown in FIGS. 10-20, it should be pointed out that the step of manipulating and folding the textile item makes a double fabric upper U developing between a front edge, in which the first end 2 and the second end 22 of the textile item overlap, and a rear edge, corresponding to at least one portion of the folding profile, wherein the front edge is configured for being closed so as to represent the toe of the upper and of the shoe thereof, and the rear edge is designed to receive the user's foot inserted into it.

Figure 20:
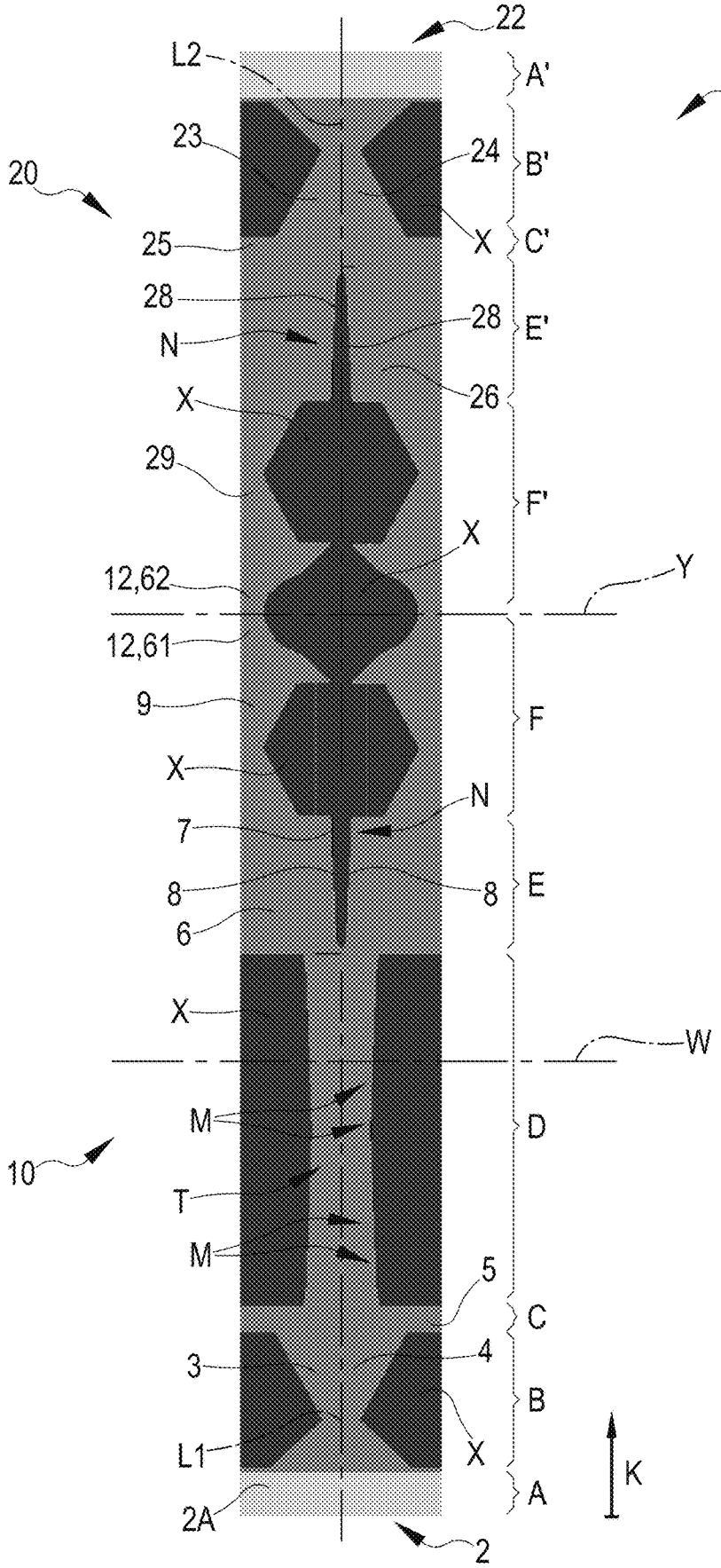
FIG. 20 schematically shows by way of example the graphic representation of a processing program to be executed on a circular textile machine so as to implement the process according to the present invention and manufacture a tubular textile article according to the present invention and as shown in FIG. 10.

The graphical representation of FIG. 20 is disclosed below, it schematically shows an example of a processing program to be executed on a circular weft knitting machine so as to implement the process according to the present invention and manufacture a tubular textile item as shown in FIGS. 10-19, i.e. with a "double fabric" (comprising both the first 10 and the second fabric 20).

Here again, the representation shows the tubular item 1 stretched as if it had been cut along a longitudinal axis, corresponding to the fabric manufacturing direction (indicated by arrow K), and therefore open; each horizontal line corresponds to a knitted course (line W indicates by way of example one row).

Black areas (referred to with X) represent needle sectors which, in certain stitch rows, are not operating. The shape of the black areas can be obtained by progressively resuming or excluding working on the needles in several successive courses.

The exclusion of given needle sections, which creates the black areas of FIG. 20, enables to give a three-dimensional shape to the tubular item, i.e. to create pockets, bulges and "protrusions" in the tubular item, which thus is not perfectly cylindrical in its whole longitudinal extension but has a precise shape that will cause the three-dimensional shape of the upper U obtained from the textile item 1.

The diagram in FIG. 20 indicates side by side the various knitting steps (A, B, C, D, E, F, F', E', C', B', A'): stitch rows associated to each step belong to the knitted portion of the textile item produced in the respective step.

Moreover, the diagram indicates the knitted structures obtained in the various steps and disclosed above: the first end 2, the elastic edge 2A, the tip portion 3, the portion of complete tubular knitted fabric 5, the tab T, the middle portion 6, the longitudinal opening 7, the lateral margins 8, the end portion 9, the edge 12.

Line Y corresponds to the junction between the first fabric 10 and the second fabric 20 made seamlessly (and coincides with the folding curve C).

Knitted fabric scales (referred to with M) in step D (needles first excluded and then resumed to operation) for making the ties 48 on the lateral margins 44 and 45 of the tab T can be seen in the diagram.

Moreover, knitted fabric scales (referred to with N) between steps E and E' (needles first excluded and then resumed to operation) for making the ties 70 between the two lateral margins 8 of the longitudinal opening 7 of the first fabric 10 and the two lateral margins 28 of the longitudinal opening 27 of the second fabric 20 can be seen in the diagram.

Figure 21:
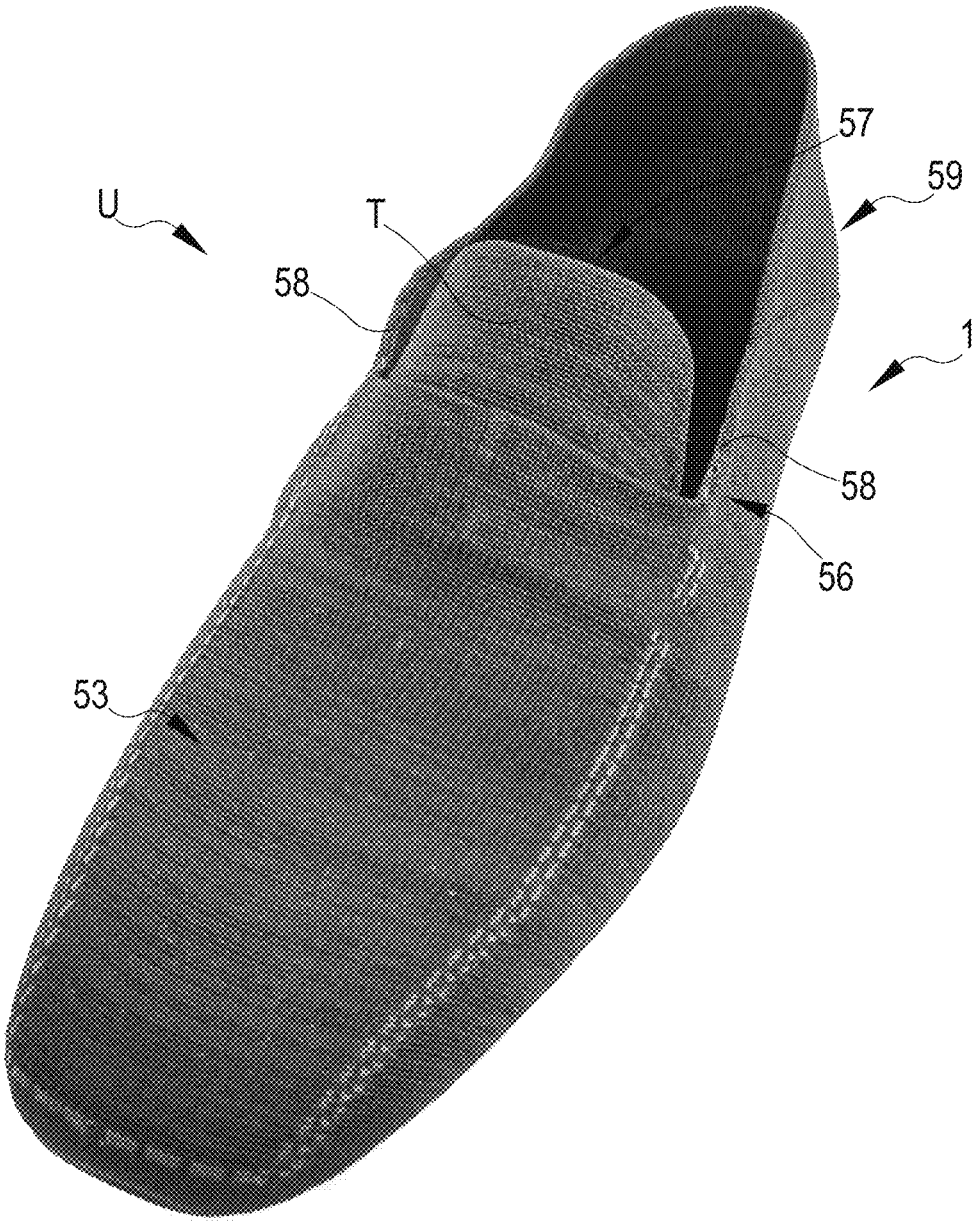
FIG. 21 shows a tubular textile article manufactured by means of the process according to the present invention, in accordance with a third example of embodiment; in particular, the textile article represents a show upper.

FIG. 21 shows a further example of embodiment of an upper U in accordance with the present invention, in particular made with a process according to the present invention. Here the upper U belongs to a moccasin: shapes differ from those of the previous embodiments, however the same structural elements of the textile item can be identified, in particular the first fabric with the tab T is destined to be folded inside the second one, which is without step D in which a tab is made.

The tubular textile article 1 may comprise different knitted structures in its various portions, based on the technical and aesthetic features to be given to the upper.

For instance, the knitted structure of the textile item may comprise terrycloth knitted portions. More to the point, the textile item may comprise openwork knitted portions.

In general, the knitted structure in the various portions of the textile item 1 is a knitted fabric obtained by actuating the needles according to one or more of the following techniques:

non-operating needle;
withdrawn needle;
unloaded needle.

Basically, the knitted structure can be chosen at will among terrycloth, openwork or a combination of knitting techniques.

Preferably, the aforesaid terrycloth knitted fabric can be:

- a full terrycloth, i.e. a terrycloth knitted fabric manufactured by making a terrycloth stitch for each needle; and/or
- a half terrycloth, i.e. a terrycloth knitted fabric manufactured by alternating terrycloth stitches and non-terrycloth stitches; and/or
- a so-called selected terrycloth, i.e. a terrycloth knitted fabric manufactured so as to obtain given shapes or texts.

The Applicant has found out that the possibility of defining at will the knitted structure of each portion of the textile item allows to give the various areas of the textile item itself certain technical features.

Preferably, though not necessarily, the circular weft knitting machine for intarsia design used for implementing the process of the present invention, can have the following technical characteristics:

several feeds, preferably 4 feeds;

selection of sinkers for each feed;

possibility of manufacturing terrycloth knitted fabric, in each feed and for each needle, in both movements of the needle-holding element, i.e. both in the forward and in the backward movement;

possibility of manufacturing openwork knitted fabric, in each feed and for each needle, in both movements of the needle-holding element, i.e. both in the forward and in the backward movement.

Preferably, each feed can deliver at least one respective yarn, in a given color and/or material, irrespective of the respective yarns of the remaining feeds.

Preferably, each feed has a plurality of yarn feeders, so that it can deliver a plurality of different yarns. For instance, it is possible to have at least four different colors and therefore manufacture terrycloth knitted fabric simultaneously with four or more different colors on the same course.

An example of circular textile machines available on the market and suitable for being used to implement the present invention and obtain tubular items as described above, is represented by machines known as "X-MACHINE" and "XT-MACHINE", designed and manufactured by the same Applicant Santoni S.p.A. These machines allow to make tubular intarsia items, which include yarns of different colors and/or materials and complex and differentiated knitted structure in the different areas of the item, without floating yarns on the reverse or trimmed yarns.

The invention achieves important advantages.

First of all, the invention allows to overcome the drawbacks of prior art.

In particular, the invention allows to make a tubular textile article with specific structural features, from which a single fabric or double fabric upper can be obtained. The features of the textile article can give the resulting upper certain technical and aesthetic properties.

The invention allows to make a tubular textile article, from which an upper can be obtained, provided with a tab T integrated into the article itself, i.e. made as one piece with the remaining parts of the textile article, which is manufactured by means of a series of seamless steps. Moreover, the tab of the textile article according to the present invention can be positioned accurately inside the article itself (and therefore in the resulting upper), and in particular it can be placed on the middle portion and below the longitudinal opening.

The invention allows to manufacture a tubular knitted item from which a double fabric or double fabric upper can be obtained, with specific technical features, in terms of comfort, wearability, cushioning or shock absorption, and/or perspiration. The textile item that can be obtained with the process of the present invention may have any structure and is stable and durable.

As disclosed above, the process of the present invention enables to obtain precise technical effects on the single fabric or double fabric item thus manufactured, and in particular to impart specific technical characteristics to given portions of the item.

The process of the present invention allows to manufacture uppers for footwear with high structural features and in a fast and economically competitive manner.

The invention claimed is:

1. Process for making a tubular textile article (1), by means of a circular knitting textile machine, destined to be an upper (U) for footwear, the process comprising the steps of:

arranging a circular knitting textile machine having at least one feed and a needle holder supporting a plurality of needles, defining a circular needle bed, which can be operated to pick up the threads dispensed by said at least one feed and to form knitted fabric; said needle holder being rotatable relative to said feed and said feed being arranged in proximity to said needle holder;

programming said circular knitting textile machine so as to define a tubular textile article (1) to be made, extending longitudinally in a seamless way starting from a first open end (2) and consisting of a plurality of stitch rows (W) in succession;

knitting with said circular knitting textile machine to make said tubular textile article (1), destined to be an upper (U) for footwear, in accordance with the above-mentioned programming step, wherein the step of knitting comprises at least the following steps:

A) making the first open end (2), belonging to a first fabric (10) of the textile article, using a needle sector, or all the needles, of said needle bed, said first open end (2) being destined to represent be a tip end of an upper;

B) making a tip portion (3) of the first fabric (10), comprising a certain number of stitch rows and consisting of a stitch bulge (4) obtained using, in successive rows, first an increasing or decreasing number of needles per row and then a decreasing or increasing number of needles per row, said tip portion of the first fabric being destined to be a portion of the upper suitable for accommodating or enclosing the toe or part of the toe;

C) making a bulge-free portion of complete tubular knitted fabric (5), along the longitudinal development of said first fabric (10), comprising a respective number of stitch rows and wherein for each row the knitted fabric produced has a closed circular profile;

D) making a tab (T), belonging to said first fabric (10) and destined to be a portion of the upper (U) suitable for enclosing or covering at least one portion of a neck of the foot/instep, wherein said step of making a tab (T) involves interrupting the processing of the preceding rows, and continuing knitting using a needle sector or all the needles of said needle bed for a certain number of stitch rows, thus producing a knitted insert representing the tab (T);

E) making a middle portion (6) of the first fabric (10), comprising a respective number of stitch rows and destined to be a portion of the upper suitable for enclosing at least part of the sole and sides of the foot, said middle portion (6) of the first fabric (10) having a longitudinal opening (7), destined to be located at at least one portion of the neck of the foot, and two lateral margins (8) on the sides of said longitudinal opening (7), wherein said middle portion (6) of the first fabric is made by using, in operation, a respective needle sector of said needle bed, comprising a preferred number of needles up to a number including all the needles of the needle bed, for a certain number of stitch rows, it being possible to change said respective needle sector for each row comprised in the middle portion;

F) making an end portion (9) of the first fabric (10), comprising a certain number of stitch rows and consisting of one or more stitch bulges (11), each obtained using, in respective successive rows, first an increasing or decreasing number of needles per row and then a decreasing or increasing number of needles per row, said end portion (9) of the first fabric (10) being destined to be a portion of the upper suitable for accommodating or enclosing the foot heel or part of the foot heel;

wherein:

in steps D and E the tab (T) and the longitudinal opening (7) of the middle portion (6) are made such that they both have a substantially simultaneous longitudinal development, in a direction corresponding to a longitudinal development of the upper (U);

the knitting step entirely produces the unitary, single-piece tubular textile article (1);

the steps are performed in succession such that processing is never interrupted between each step and the following one.

2. The process according to claim 1, wherein steps D and E make the tab (T) and the middle portion (6), seamlessly with respect to each other, so that—in the upper resulting from the tubular textile article—the tab (T) it is at least partially covered or overhung by said lateral margins (8) of the middle portion (6), and wherein steps D and E make the tab (T) and the middle portion (6), seamlessly with respect to each other, so that—in the upper resulting from the tubular textile article (1)—the tab (T) is located below the longitudinal opening (7);

or wherein steps D and E make a tab (T) integral with the remaining parts of the textile article (1), or wherein the tab (T) can protrude from the longitudinal opening (7) of the middle portion (6), that is—in the upper resulting from the tubular article—the tab is not completely covered and accessible from the outside at the longitudinal opening of the middle portion, in the area between the two margins of the longitudinal opening.

3. The process according to claim 1, wherein:

step A is the first step performed in said knitting step with said circular knitting textile machine, the knitting of said textile article starting from said first open end (2), or step A is the last step performed in said knitting step with said circular knitting textile machine, the knitting of said textile article ending with said first open end (2);

and/or wherein:

said knitting step involves performing the steps in sequence in an order A-B-C-D-E-F, seamlessly between each step and the following one, or said knitting step involves performing the steps in sequence in an order F-E-D-C-B-A, seamlessly between each step and the following one, wherein in the above-mentioned sequences steps C are optional.

4. The process according to claim 1, wherein step D is performed with a circular knitting textile machine operating in an alternating motion, to make the tab (T), through an alternation of revolutions of the needle holder in one direction and in the opposite direction, selecting a needle sector of the circular needle bed for making the tab and using in each revolution a certain number or set of needles of such sector, and/or wherein in step D the number of needles used in each revolution in an alternating motion of the circular knitting textile machine can be varied in such a way as to shape the tab along its longitudinal development, row by row, and/or wherein in step D the sector of needles used in the alternating motion of the circular knitting textile machine can comprise any preferred number of needles up to a maximum of all the needles of the needle bed, and/or wherein step D ends, when the desired length of the tab (T) is obtained, with the unloading of the needles used for making the tab itself, which ends with a free edge, i.e. not connected to other parts of the textile article, and the insert representing the tab consists of a single layer of fabric connected to the textile article at the stitch made at the beginning of step D.

5. The process according to claim 1, wherein step D:

starts by selecting, with an alternating motion, a sector of needles used for making the tab (T), and within such sector a certain number of needles is kept in the idle position for the entire processing of the tab, which is made with the remaining needles of said sector;

continues by longitudinally developing the tab in a continuous way, for an extension which is twice its final extension;

ends by resuming the processing by the above-mentioned needles previously kept in the idle position, so that the last stitch made in step D is located at the first stitch made in step D;

in this way, the tab (T) consists of a double fabric, that is, two layers of fabric (42, 43) folded onto each other along a fold line (49), the latter substantially corresponding to the stitch made halfway through step D, and/or wherein making the double fabric tab (T) provides for the textile processing in step D to end with the same number of needles with which step D itself started.

6. The process according to claim 1, wherein step D involves textile processing known in the art with the term "button", which allows to start and end the tab (T) in the same position, seamlessly with the rest of the textile article (1), and/or wherein in step D the step of interrupting the processing involves stopping a certain number of needles which are contiguous in operation in the preceding rows, and/or wherein in step D the step of continuing knitting involves continuing only with one needle sector of said needle bed.

7. The process according to claim 1, wherein, if step D makes a tab consisting of a double fabric, the tab (T) has two free lateral edges (44, 45), each extending along the entire longitudinal development of the double fabric tab (T), said two lateral edges being linear or shaped, the double fabric tab having two lateral openings (46, 47) at the two lateral edges (44, 45), or wherein, if step D makes a tab (T) consisting of a double fabric, the tab has two lateral edges, each extending along the entire longitudinal development of the double fabric tab, wherein:

the two lateral edges (44, 45) are made for a first half of the longitudinal extension of the tab (T), up to said fold line (49), by inserting one or more scales, preferably a plurality of scales, reducing the number of needles in operation and leaving the excluded needles, in the idle position, with the knitted fabric retained in the needle head;

the two lateral edges (44, 45) are made for a second half of the longitudinal extension of the tab, beyond said fold line (49), gradually resuming the above-mentioned scales, increasing the number of needles in operation and reconnecting the knitted stitches of the needles previously excluded to the knitted fabric made in the second half of the lateral edges;

thus obtaining a double fabric tab (T) wherein each of the two lateral edges (44, 45) has ties (48) between its first half and its second half, along the longitudinal development, so that on the lateral edges of the double fabric tab there are one or more closing stitches (48), each corresponding to a respective knitted fabric scale.

8. The process according to claim 1, wherein step E is performed with a circular knitting textile machine operating in an alternating motion, to make the median portion of the first fabric, through an alternation of revolutions of the needle holder in one direction and in the opposite direction, using in each revolution a certain needle sector with a respective number of needles of the circular needle bed, up to a maximum of all the needles of the needle bed, and/or wherein in step E the number of needles used in each revolution in an alternating motion of the circular knitting textile machine can be varied in such a way as to shape the middle portion (6) of the first fabric and the longitudinal opening (7), row by row, and/or wherein step E provides for a progressive variation in the number of needles used in making the knitted fabric, in order to give the above-mentioned longitudinal opening (7) of the middle portion (6) of the first fabric (10) a "V" shape, and/or wherein said progressive variation in the number of needles in step E can be:

a progressive decrease in the number of needles if the median portion (6) of the first fabric is made following step D and before step F, by first making a final vertex of the longitudinal opening (7);

a progressive increase in the number of needles if the median portion (6) of the first fabric is made following step F and before step D, by lastly making a final vertex of the longitudinal opening (7).

9. The process according to claim 1, wherein in the transition from step D to step E a replacement of the needles being used takes place, and in step D; needles belonging to a needle sector are used to make the tab (T) close to the longitudinal opening (7) made in step E and/or belonging to a needle sector not used in step E during the definition of the longitudinal opening (7) of the middle portion (6) of the first fabric (10), thus causing the tab (T) to be at least partially overlapped by the lateral margins (8) of the middle portion (6), and vice versa the longitudinal opening (7) of the middle portion shows at least partially, underneath the same, the tab (T), and/or wherein, if making the middle portion of the first fabric in step E does not affect all the needles in the bed, one or more of the needles not used—in the definition of the longitudinal opening—correspond to needles that contribute in step D to making the tab (T), and/or wherein, if making the tab in step D has not affected all the needles in the bed, in step E, for making the middle portion of the first fabric, at least some needles belonging to the sector of needles not selected in step D for making the tab are used.

10. The process according to claim 1, wherein the knitting step comprises one or more of the following steps:

F') seamlessly with the end portion (9) of the first fabric (10), made in step F, making an initial portion (29) of a second fabric (20) of the textile article (1), extending longitudinally in a seamless way with respect to the first fabric (10), the initial portion (29) of the second fabric (20) comprising a certain number of stitch rows and consisting of one or more stitch bulges, each obtained using, in respective successive rows, first an increasing or decreasing number of needles per row and then a decreasing or increasing number of needles per row, said initial portion (29) of the second fabric being destined to be a portion of the upper (U) suitable for accommodating or enclosing the foot heel or part of the foot heel;

E') making a middle portion (26) of the second fabric (20), comprising a respective number of stitch rows and destined to be a portion of the upper suitable for enclosing at least part of the sole and sides of the foot, said middle portion (26) of the second fabric (20) having a respective longitudinal opening (27), destined to be located at at least one portion of the neck of the foot, and two respective lateral margins (28) on the sides of said longitudinal opening (27), wherein said middle portion (26) of the second fabric is made by using, in operation, a respective needle sector of said needle bed, comprising a preferred number of needles up to a number including all the needles of the needle bed, for a certain number of stitch rows, it being possible to change said respective needle sector for each row comprised in the middle portion;

C') optionally, making a bulge-free portion of complete tubular knitted fabric (25), along the longitudinal development of said second fabric (20), comprising a respective number of stitch rows and wherein for each row the knitted fabric produced has a closed circular profile;

B') making a tip portion (23) of the second fabric (20), comprising a certain number of stitch rows and consisting of a stitch bulge (24) obtained using, in successive rows, first an increasing or decreasing number of needles per row and then a decreasing or increasing number of needles per row, said tip portion of the second fabric being destined to be a portion of the upper suitable for accommodating or enclosing the toe or part of the toe;

A') making a second open end (22) of the textile article (1), corresponding to one end of the second fabric (20), using a needle sector, or all the needles, of said needle bed, said second open end being destined to be a tip end of an upper.

11. The process according to claim 10, wherein the second open end (22) of the textile article (1) is longitudinally opposite with respect to said first open end (2), and wherein the tubular textile article (1) develops seamlessly, in a single piece, between the first end and the second end, and/or wherein the first and second open ends of the textile article represent a beginning and an end, or vice versa an end and a beginning, of said knitting step with said circular knitting textile machine and in accordance with said programming step, and/or wherein the second fabric (20) does not comprise knitted fabric portions or steps configured to define a tab of the type made, in the first fabric, in step D, or the second fabric does not comprise a tab overlapped by the lateral margins of the middle portion, and/or wherein the second fabric (20) is made in an opposite way as compared to the first fabric (10), the second fabric (20) developings in a specular manner, and seamlessly, from the end of the end portion (9) of the first fabric (10), starting from its initial portion (29), and/or wherein the second fabric (20) is made with the same steps and in reverse sequence with respect to the first fabric, with the exception of step D not being present in making the second fabric.

12. The process according to claim 10, wherein the second fabric (20) is symmetrical and structurally specular, with the exception of the tab, with respect to the first fabric (10), i-e:

the second fabric comprising the same portions as the first fabric made with the same step, with the exception of the tab, and wherein:

the first open end (2) made in step A and the second open end (22) made in step A' are corresponding to one another, both open ends being destined to be, or to be located at, one tip end of an upper; and/or the tip portion (3) of the first fabric (10) made in step B and the tip portion (23) of the second fabric (20) made in step B' are corresponding to one another, both tip portions being destined to be, or be located at, one portion of the upper suitable for accommodating or enclosing the toe or part of the toe; and/or optionally, the portion of complete tubular knitted fabric (5) of the first fabric (10) made in step C and the portion of complete tubular knitted fabric (25) of the second fabric (20) made in step C' are corresponding to one another; and/or the middle portion (6) of the first fabric (10) made in step E and the middle portion (26) of the second fabric (20) made in step E' are corresponding to one another, and in particular have corresponding longitudinal openings (7, 27), destined to be located at a same portion of the neck of the foot, and corresponding lateral margins (8, 28) on the sides of the respective longitudinal opening, both middle portions being destined to be, or to be located at, one portion of the upper suitable for enclosing at least part of the sole and the sides of the foot; and/or the end portion (9) of the first fabric (10) made in step F and the initial portion (29) of the second fabric (20) made in step F' are corresponding to one another, both tip portions being destined to be, or be located at, one portion of the upper suitable for accommodating or enclosing the heel of the foot or part of the heel of the foot.

13. The process according to claim 10, wherein:

step A' is the last step performed in said knitting step with said circular knitting textile machine, the knitting of said textile article ending with said second open end of the textile article, belonging to the second fabric, or step A' is the first step performed in said knitting step with said circular knitting textile machine, the knitting of said textile article starting from said second open end of the textile article, belonging to the second fabric;

and/or wherein:

said knitting step involves performing the steps in sequence in an order A-B-C-D-E-F-F'-E'-C'-B'-A', seamlessly between each step and the following one, or said knitting step involves performing the steps in sequence in an order A'-B'-C'-E'-F'-F-E-D-C-B-A, seamlessly between each step and the following one, wherein in the above-mentioned sequences steps C and C' are optional.

14. The process according to claim 10, wherein the first fabric (10) of the textile article (1) is the one comprising the tab (T), while the second fabric (20) is the one without the tab, and wherein the first fabric (10) comprises an external surface (31) and an internal surface (32), and the second fabric (20) comprises a respective external surface (91) and a respective internal surface (92), wherein the external surface (31) of the first fabric (10) is connected to, and continues seamlessly in, the external surface (91) of the second fabric (20), and the internal surface (32) of the first fabric is connected to, and continues seamlessly in, the internal surface (92) of the second fabric, and wherein the process comprises, following the knitting step with the circular knitting textile machine to make the tubular textile article, a step of manipulating and folding the textile article to make an upper, and in such a way that:

the first fabric (10), that is the fabric comprising the tab (T), is folded inside the second fabric (20), along a folding profile;

the inside (32) of the first fabric contacts the inside (92) of the second fabric, both—with the upper in use—without contacting the user's foot or the outside of the upper;

the outside (31) of the first fabric (10) is folded inside the second fabric (20), so that the outside (31) of the first fabric is, with the upper in use, facing the user's foot;

the outside (91) of the second fabric (20) represents—with the upper in use—an external surface of the upper, and wherein the first fabric (10) is the one destined to be folded inside the second fabric (20).

15. The process according to claim 14, wherein, following said step of manipulating and folding the textile article, the portions representing the second fabric (20) match and contact the corresponding portions representing the first fabric (10), and in particular:

the first open end (22) made in step A matches the second open end (22) made in step A', obtaining a double-layer open end; and/or the tip portion (3) of the first fabric (10) made in step B matches the tip portion (23) of the second fabric (20) made in step B', obtaining a double-layer tip portion (53); and/or optionally, the portion of complete tubular knitted fabric (5) of the first fabric (10) made in step C matches the portion of complete tubular knitted fabric (25) of the second fabric (20) made in step C', obtaining a double-layer complete tubular knitted fabric (55); and/or the middle portion (6) of the first fabric (10) made in step E matches the middle portion (26) of the second fabric (20) made in step E', obtaining a double-layer middle portion (56);

the longitudinal opening (7) of the first fabric (10) matches the longitudinal opening (27) of the second fabric (20), obtaining a double-layer longitudinal opening (57);

the lateral margins (8) of the middle portion of the first fabric (10) match the lateral margins (28) of the middle portion of the second fabric (20), obtaining double-layer lateral margins (58); and/or the end portion (9) of the first fabric (10) made in step F matches the initial portion (29) of the second fabric (20) made in step F', obtaining a double-layer end portion (59).

16. The process according to claim 14, wherein, following said step of manipulating and folding the textile article (1) to make an upper (U), the tab (T) is located below both longitudinal openings (7, 27) of the first fabric (10) and second fabric (20) and is at least partially covered or overhung by both pairs of lateral margins (8, 28) of the middle portions (6, 26) of the first and second fabrics, and/or wherein the manipulation of the textile article to complete the making of the double-fabric upper (U) contemplates that the first fabric (10), comprising the tab (T), is inserted inside the second fabric (20), without the tab, so that the tab belonging to the first fabric is at least partially below the double-layer longitudinal opening (57), and/or wherein the tab (T) protrudes from the outside of the first fabric (10), which then becomes the inside of the upper.

17. The process according to claim 10, wherein:

in step E, the two lateral margins (8) of the longitudinal opening (7) of the first fabric (10) are made by inserting one or more scales, preferably a plurality of scales, reducing the number of needles in operation and leaving the excluded needles, in the idle position, with the knitted fabric retained in the needle head;

subsequently, in step E' the two lateral margins (28) of the longitudinal opening (27) of the second fabric (20) are made by progressively resuming the above-mentioned scales introduced in step E, increasing the number of needles in operation and reconnecting the knitted stitches of the needles previously excluded to the knitted fabric made in step E;

thus obtaining a double-fabric middle portion wherein each of the two lateral margins (8) of the first fabric has ties (70) to the corresponding lateral margin (28) of the second fabric, along the longitudinal development of the margins, such that—once the tubular article (1) has been manipulated to make a double-fabric upper (U)—the pairs of corresponding lateral margins of the first and second fabrics have one or more closing stitches (70), each corresponding to a respective knitted fabric scale, and/or wherein the ties (70) are positioned on the folding profile between the first and second fabric, that is, along the line where the first fabric is folded inside the second fabric.

18. The process according to claim 1, comprising a step of closing the first open end (2) of the first fabric, and/or wherein the step of closing the first end can take place directly at the circular knitting textile machine that makes the textile article, before the article is unloaded from the circular knitting textile machine, or following the unloading of the textile article, and/or wherein the method comprises a step of closing the second open end (22) of the second fabric, and/or wherein the step of closing the second end can take place directly at the circular knitting textile machine that makes the textile article, before the article is unloaded from the circular knitting textile machine, or after unloading the textile article.

19. Upper (U) for footwear made with a tubular textile article (1) obtained by a process according to claim 1.

* * * * *